US006798529B2

(12) United States Patent
Saka et al.

(10) Patent No.: US 6,798,529 B2
(45) Date of Patent: Sep. 28, 2004

(54) IN-SITU METHOD AND APPARATUS FOR END POINT DETECTION IN CHEMICAL MECHANICAL POLISHING

(75) Inventors: Nannaji Saka, Cambridge, MA (US); Jamie Nam, Cambridge, MA (US); Hilario L. Oh, Rochester Hills, MI (US)

(73) Assignees: Aviza Technology, Inc., Scotts Valley, CA (US); Massachusetts Institute of Technology, Cambridge, MA (US)

( * ) Notice: Subject to any disclaimer, the term of this patent is extended or adjusted under 35 U.S.C. 154(b) by 0 days.

(21) Appl. No.: 10/029,080

(22) Filed: Dec. 21, 2001

(65) Prior Publication Data

US 2003/0045100 A1 Mar. 6, 2003

Related U.S. Application Data

(63) Continuation-in-part of application No. 09/628,471, filed on Jul. 31, 2000, now Pat. No. 6,476,921.
(60) Provisional application No. 60/258,931, filed on Dec. 29, 2000.

(51) Int. Cl.[7] ..... G01B 11/14
(52) U.S. Cl. ..... 356/630
(58) Field of Search ..... 356/630, 38, 325, 356/328; 451/6, 285–288, 41, 63, 28, 397, 398

(56) References Cited

U.S. PATENT DOCUMENTS 4,959,113 A 9/1990 Roberts
5,069,002 A 12/1991 Sandhu et al.
5,433,651 A 7/1995 Lustig et al.
5,486,129 A 1/1996 Sandhu et al.
5,605,488 A 2/1997 Ohashi et al.
5,672,091 A 9/1997 Takahashi et al.
5,676,587 A 10/1997 Landers et al.
5,770,103 A 6/1998 Wang et al.
5,835,225 A 11/1998 Thakur
5,838,448 A 11/1998 Aiyer et al.
5,840,629 A 11/1998 Carpio
5,897,375 A 4/1999 Watts et al.
5,916,016 A 6/1999 Bothra
5,923,408 A * 7/1999 Takabayashi ..... 355/53

(List continued on next page.)

FOREIGN PATENT DOCUMENTS

EP 0881484 A2 12/1998
WO WO 99/02304 A1 1/1999

OTHER PUBLICATIONS

Adams, et al., "*Process Control and Endpoint Detection with Fullscan ISRM System in Chemical Mechanical Polishing of Cu Layers*," CMP–MIC, Mar. 2000, 5 pages.

(List continued on next page.)

*Primary Examiner*—Michael P. Stafira
(74) *Attorney, Agent, or Firm*—Dorsey & Whitney LLP

(57) ABSTRACT

A method and apparatus for providing in-situ monitoring of the removal of materials in localized regions on a semiconductor wafer or substrate during chemical mechanical polishing (CMP) is provided. In particular, the method and apparatus of the present invention provides for detecting the differences in reflectance between the different materials within certain localized regions or zones on the surface of the wafer. The differences in reflectance are used to indicate the rate or progression of material removal in each of the certain localized zones.

27 Claims, 29 Drawing Sheets

U.S. PATENT DOCUMENTS

| | | | |
|---|---|---|---|
| 5,953,115 | A | 9/1999 | Landers |
| 5,954,997 | A | 9/1999 | Kaufman et al. |
| 5,964,643 | A | 10/1999 | Birang et al. |
| 5,964,653 | A | 10/1999 | Perlov et al. |
| 5,972,787 | A | 10/1999 | Boggs et al. |
| 5,985,679 | A | 11/1999 | Berman |
| 5,985,748 | A | 11/1999 | Watts et al. |
| 6,001,730 | A | 12/1999 | Farkas et al. |
| 6,004,187 | A | 12/1999 | Nyui et al. |
| 6,036,587 | A | 3/2000 | Tolles et al. |
| 6,046,111 | A | 4/2000 | Robinson |
| 6,056,632 | A | 5/2000 | Mitchel et al. |
| 6,062,133 | A | 5/2000 | Blalock |
| 6,062,952 | A | 5/2000 | Robinson et al. |
| 6,063,306 | A | 5/2000 | Kaufman et al. |
| 6,068,539 | A | 5/2000 | Bajaj et al. |
| 6,068,549 | A | 5/2000 | Jackson |
| 6,071,177 | A | 6/2000 | Lin et al. |
| 6,074,287 | A | 6/2000 | Miyaji et al. |
| 6,077,452 | A | 6/2000 | Litvak |
| 6,179,956 | B1 | 1/2001 | Nagahara et al. |
| 6,204,922 | B1 | 3/2001 | Chalmers |
| 6,238,590 | B1 | 5/2001 | Fischer et al. |
| 6,257,953 | B1 | 7/2001 | Gitis et al. |
| 6,290,584 | B1 | 9/2001 | Kim et al. |
| 6,476,921 | B1 * | 11/2002 | Saka et al. ..... 356/630 |

OTHER PUBLICATIONS

Bonner et al., "*Removal Rate, Uniformity and Defectivity Studies of Chemical Mechanical Polishing of BPSG Films*," MRS, Spring 2000, 6 pages.

Garretson et al., "*New Pad Conditioning Disk Design Delivers Excellent Process Performance While Increasing CMP Productivity*," CMP Technology for ULSI Interconnection, SEMICON West 2000, 9 pages.

Osterheld et al., "*A Novel Retaining Ring in Advanced Polishing Head Design for Significantly Improved CMP Performance*," MRS, Apr. 5–9, 1999, 8 pages.

Römer et al., "*STI CMP Using Abrasive Demands Measurement Methods and Results*," CMP–MIC, Mar. 2000, 10 pages.

Surana et al., "Defectivity Reduction in Copper CMP Processes," VMIC, Jun. 2000, 3 pages.

Tang, et al., "*Novel Integrated Single Wafer Immersion Megasonics for Advanced Post CMP Cleaning in a Next Generation Dry–in Dry–out CMP System*," CMP–MIC, Mar. 2000, 5 pages.

* cited by examiner

Scematics of light scattering on a patterned Cu surface.

Schematics of light scattering from a planar composite surface.

Schematics of light scattering from a wavy composite surface.

Sensor kinematics.

The simulated locus for the reflectance sensor across the wafer at the condition $\omega_w = \omega_p$ and $r_s = r_{cc}$.

The simulated locus for the reflectance sensor across the wafer at the condition $\omega_w = 1.05\omega_p$ and $r_s = r_{cc}$.

The results of off-line measurements at the Cu Planarization regimes on the pattern with 0.5 area fraction ($\omega/\lambda = 0.5$).

The results of off-line measurements at the Cu Planarization regimes on the patterns with 0.01 area fraction ($\omega/\Lambda$ = 0.1).

Time evolution of step-heights for patterns with constant area fraction 0.5 and 0.01.

The results of off-line measurements at various process reqimes on the pattern with 0.5 area fraction.

The results of off-line measurements at various process regimes on the pattern with 0.01 area fraction.

Time evolution of Cu dishing for patterns with constant area fraction 0.5 and various linewidths.

Time evolution of Cu dishing for patterns with constant area fraction 0.01 and various linewidths.

Off-line measurements of the mean and standard deviation of surface reflectance along different loci across the wafer at the onset of endpoint.

Comparison of the off-line measurements (mean and standard deviation) on the center die and across wafer at various polishing stages. The across-wafer data is calculated based on the measurements along five loci.

Raw data from in-situ reflectance measurement.

Results of in-situ measurements of the moving average and standard deviation of wafer-level surface reflectance.

Results of in-situ measurements of the standard deviation of wafer-level surface reflectance.

Distribution of surface reflectance versus polishing time from the in-situ measurements.

The simulated loci for the reflectance sensor across the wafer at the condition $1.05\omega_w = \omega_p$ and $r_s = 1.25r_{cc}$.

Decomposition of the within-wafer and within-die variance for the in-situ measurements.

Results of the moving average versus time with estimated interval at 99.5% confidence interval.

Results of in-situ measurements of the standard deviation to the mean reflectance (wafer-level).

Results of the range of surface reflectance versus polishing time (wafer-level).

IN-SITU METHOD AND APPARATUS FOR END POINT DETECTION IN CHEMICAL MECHANICAL POLISHING

RELATED APPLICATIONS

This patent application is a continuation-in-part of U.S. application Ser. No. 09/628,471, filed Jul. 31, 2000, now U.S. Pat. No. 6,476,921, which is incorporated herein by reference. The present invention claims the benefit of U.S. provisional patent application Serial No. 60/258,931, filed Dec. 29, 2000, which is incorporated herein by reference in its entirety. The present invention claims priority to PCT Application No. PCT/US01/24146, filed Jul. 31, 2001, which is incorporated herein by reference in its entirety. This patent application is related to co-pending application Ser. No. 09/628,563, filed Jul. 31, 2000, which is incorporated by reference in its entirety.

BRIEF DESCRIPTIONS OF THE INVENTION

The present invention relates to an in-situ method and apparatus for end point detection during chemical mechanical polishing, and more particularly to a method and apparatus in which localized areas of the surface of a semiconductor wafer or substrate which is undergoing chemical mechanical polishing are monitored to detect the removal of material from the localized wafer surface areas.

RELEVANT LITERATURE

The following literature references describe chemical mechanical polishing and various prior art end point detecting techniques.

Bahar, E., 1981, "Scattering Cross Sections for Composite Random Surfaces: Full Wave Analysis," *Radio Sci.*, Vol. 16, pp. 1327–1335.

Bakin, D. V., Glen, D. E., and Sun, M. H., 1998, "Application of Backside Fiber-Optic System for In situ CMP Endpoint Detection on Shallow Trench Isolation Wafers," *Proc. of SPIE*, Vol. 3507, pp. 210–207.

Banet, M. J., Fuchs, M., Rogers, J. A., Reinold, J. H., Knecht, J. M., Rothschild, M., Logan, R., Maznev, A. A., and Nelson, K. A., 1998, "High-Precision Film Thickness Determination Using a Laser-Based Ultrasonic Technique," *Appl. Phys. Lett.*, Vol. 73, pp. 169–171.

Beckage, P. J., Lukner, R., Cho, W., Edwards, K., Jester, M., and Shaw, S, 1999, "Improved Metal CMP Endpoint Control by Monitoring Carrier Speed Controller Output or Pad Temperature," *Proc. of SPIE*, Vol. 3882, pp. 118–125.

Bibby, T. and Holland, K., 1998, "Endpoint Detection in CMP," *J. Electronic Materials*, Vol. 27, pp. 1073–1081.

Bibby, T., Adams, J. A., and Holland, K., 1999, "Optical Endpoint Detection for Chemical Mechanical Planarization," *J. Vac. Sci. Technol. B*, Vol. 17, pp. 2378–2384.

Chan, D. A., Swedek, B., Wiswesser A., and Birang, M., 1998, "Process Control and Monitoring with Laser Interferometry Based Endpoint Detection in Chemical Mechanical Planarization," 1998 *IEEE/SEMI Advanced Semiconductor Mfg. Conf. and Workshop*, pp. 377–384.

Desanto, J. A., 1975, "Scattering from a Perfectly Reflecting Arbitrary Periodic Surface: An Exact Theory," *Radio Sci.*, Vol. 16, pp. 1315–1326.

Desanto, J. A., 1981, "Scattering from a Sinusoid: Derivation of Linear Equations for the Field Amplitudes," *J. Acoustical Soc. Am.*, Vol. 57, pp. 1195–1197.

Drain, D., 1997, *Statistical Methods for Industrial Process Control*, Chapman and Hall, New York.

Eckart, C., 1933, "A general Derivation of the Formula for the Diffraction by a Perfect Grating," *Physical Review*, Vol. 44, pp. 12–14.

Fang, S. J., Barda, A., Janecko, T., Little, W., Outley, D., Hempel, G., Joshi, S., Morrison, B., Shinn, G. B., and Birang, M., 1998, "Control of Dielectric Chemical Mechanical Polishing (CMP) Using an Interferometry Based Endpoint Sensor," *Proc. IEEE* 1998 *International Interconnect Technol. Conf.*, pp. 76–78.

Joffe, M. A., Yeung, H., Fuchs, M., Banet, M. J., and Hymes, S., 1999, "Novel Thin-Film Metrology for CMP Applications," *Proc.* 1999 *CMP-MIC Conf.*, pp. 73–76.

Leach, M. A., Machesney, B. J., and Nowak, E. J., U.S. Pat. No. 5,213,655, May 25, 1993.

Litvak, H. E. and Tzeng, H.-M., 1996, "Implementing Real-Time Endpoint Control in CMP," *Semiconductor International*, Vol., pp. 259–264.

Marcoux, P. J. and Foo, P. D., 1981, "Methods of End Point Detection for Plasma Etching," *Solid State Technology*, Vol., pp. 115–122.

Montgomery, D. C., 1996, *Introduction to Statistical Quality Control,* 3rd ed., John Wiley & Sons., Inc., New York, pp. 101–111.

Murarka, S., Gutmann, R., Duquette, D., and Steigerwald, J, U.S. Pat. No. 5,637,185, Jun. 10, 1997.

Lord Rayleigh, 1907, "On the Dynamical Theory of Gratings," *Proc. Roy. Soc., A,* Vol. 79, pp. 399–416.

Park, T., Tugbawa, T., Boning, D., Chung, J., Hymes, S., Muralidhar, R., Wilks, B., Smekalin, K., Bersuker, G., 1999, "Electrical Characterization of Copper Chemical Mechanical Polishing," *Proc.* 1999 *CMP-MIC Conf.*, pp. 184–191.

Rogers, J. A., Fuchs, M., Banet, M. J., Hanselnan, J. B., Logan, R., and Nelson, K. A., 1997, "Optical System for Rapid Materials Characterization with Transient Grating Technique: Application to Nondestructive Evaluation of Thin Films Used in Microelectronics," *Appl. Phys. Lett.*, Vol. 71(2), pp. 225–227.

Sachs, L., *Applied Statistics: A Handbook of Techniques*, translated by Reynarowych, Z., Springer-Verlag, New York.

Sandhu, G., Schultz, L., and Doan, T., U.S. Pat. No. 5,036,015, Jul. 30, 1991.

Schultz, L., U.S. Pat. No. 5,081,796, Jan. 21, 1992.

Smith, W. L., Kruse, K., Holland, K., and Harwood, R., 1996, "Film Thickness Measurements for Chemical Mechanical Planarization," *Solid State Technol.*, Vol., pp. 77–86.

Steigerwald, J. M., Zirpoli, R., Murarka, S. P., Price, D. and Gutmann, R. J., 1994, "Pattern Geometry Effects in the Chemical-Mechanical Polishing of Inlaid Copper Structures," *J. Electrochem. Soc.*, Vol. 141, pp. 2842–2848.

Stine, B. E., 1997, "A General Methodology for Acessing and Characterizing Variation in Semiconductor Manufacturing", Ph.D. Thesis, Massachusetts Institute of Technology.

Stien, D. J. and Hetherington, D. L., 1999, "Prediction of Tungsten CMP Pad Life Using Blanket Romoval Rate Data and Endpoint Data Obtained from Process Temperature and Carrier Motor Current Measurements," *Proc. of SPIE*, Vol. 3743, pp. 112–119.

Uretsky, J. L., 1965, "The Scattering of Plane Waves from Periodic Surfaces," *Annals of Phys.*, Vol. 33, pp. 400–427.

Zeidler, D., Plotner, M., and Drescher, K., 2000, "Endpoint Detection Method for CMP of Copper," *Microelectronic Engineering*, Vol. 50, pp. 411–416.

Zipin, R. B, 1966, "A Preliminary Investigation of Bidirectional Spectral Reflectance of V-Grooved Surfaces," *Appl. Optics*, Vol. 5, pp. 1954–1957.

BACKGROUND OF THE INVENTION

Manufacture of semiconductors has become increasingly complex as the device densities increase. Such high density circuits typically require closely spaced metal interconnect lines and multiple layers of insulating material, such as oxides, formed atop and between the interconnect lines. Surface planarity of the semiconductor wafer or substrate degrades as the layers are deposited. Generally, the surface of a layer will have a topography that conforms to the sublayer, and as the number of layers increase the non-planarity of the surface becomes more pronounced.

To address the problem, chemical mechanical polishing (CMP) processes are employed. The CMP process removes material from the surface of the wafer to provide a substantially planar surface. More recently, the CMP process is also used to fabricate the interconnecting lines. For example, when depositing copper leads or interconnect lines, a full layer of the metal 13 is deposited on the surface of the wafer 10 having grooves 12 formed in an oxide layer 11 as shown in FIGS. 1A and 1B. The metal layer 13 may be deposited by sputtering or vapor deposition or by any other suitable conventional technique. The oxide layer, such as doped or undoped silicon dioxide, is usually formed by chemical vapor deposition (CVD). The metal layer covers the entire surface of the wafer and extends into the grooves. Thereafter, individual leads 16 are defined by removing the metal layer from the surface of the oxide. The CMP process may be used to remove the surface metal leaving the leads 16 in the grooves. The leads are insulated from one another by the intervening oxide layer.

In general, to carry out the CMP process, a chemical mechanical polishing (CMP) machines is used. Many types of CMP machines are used in the semiconductor industry. CMP machines typically employ a rotating polishing platen having a polishing pad thereon, and a smaller diameter rotating wafer carrier which carries the wafer whose surface is to be planarized and/or polished. The surface of the rotating wafer is held or urged against the rotating polishing pad. A slurry is fed to the surface of the polishing pad during polishing of the wafer.

It is desirable to precisely determine when the material has been removed from the upper surface of the wafer during the CMP process. This not only prevents discarding of over-polished wafers, but also minimizes the necessity of re-polishing any under-polished wafers. There are many possible ways of determining when to stop the CMP process. Typical methods include: (1) detecting frictional change as the top layer of metal is polished away to expose the silicon oxide layer by monitoring the current to the platen and carrier motors, and (2) monitoring thermal and acoustic signatures from the polishing pad. Electrical impedance, conductance and capacitance can also be used to determine the presence of the metal layers.

More recently, optical measurement has been used in the art with the CMP process. For example, U.S. Pat. No. 5,838,448 uses interferometry and describes detecting the thickness of a thin layer, or the changes in the film thickness, by measuring reflectance variations caused by a change in the incidence angle of incident light. U.S. Pat. No. 5,835,225 describes using reflectance measurements to determine a particular surface property of the substrate. U.S. Pat. No. 5,433,651 describes a method and apparatus for viewing the wafer during polishing and end-pointing the CMP process when a prescribed change in the in-situ reflectance corresponds to a prescribed condition of the polishing process.

While these techniques have provided improvements to the CMP process, these methods provide average (global) characteristics of the whole wafer surface, rather than those of smaller, localized regions or areas of the wafer. This means that, although one part of the wafer may get polished before another, the global system is not typically able to differentiate between over-polished and under-polished regions of the wafer.

In another prior art technique, as described in U.S. Pat. No. 5,972,787, indicator areas are provided on the wafer. These indicator areas are formed of blocks of parallel metal lines with varying line widths and pattern factors that are chosen to violate existing ground rules in such a way that they will be dished out using the standard consumable set (pad/slurry) of a given metal CMP process. The blocks are then inspected to determine the extent of polishing. While this technique provides for indicating the polishing in certain areas of the wafer, the process requires that the CMP step be interrupted for the inspection to take place. Further, the indicator areas require formation of the blocks which add an additional step to the already complex fabrication process.

In addition, the copper (Cu) damascene process is emerging as a critical technology to produce high-speed, high-performance, and low energy-consuming Ultra-Large-Scale Integrated (ULSI) circuits. In copper damascene, the CMP process is employed to remove the excess copper and barrier materials (typically Ta, Ti, TaN or TiN) and to form interconnects inside the trenches in the inter-layer dielectric (ILD, typically $SiO_2$ or polymers). The copper damascene process adds additional complexities to the CMP process. It has been reported that the material removal rate of Cu strongly depends on the pattern geometry. The nonuniform pattern layout usually causes nonuniform polishing across the die area, and results in partial overpolishing on the area with higher Cu fraction and dishing on the soft Cu lines. The Cu loss and surface nonuniformity due to overpolishing and dishing may affect the reliability of interconnects and must be minimized. Additionally, the nonuniformity of initial Cu coating, the spatial variation of the process parameters (velocity, pressure, slurry transport, etc.), and the process random variation will increase the within-wafer and within-lot nonuniformity of polishing. These result in a variation of the completion time, or the endpoint, of the Cu CMP and impact the process yield. In order to reduce the variance of polishing outputs (uniformity, overpolishing and dishing), it is desirable to integrate an in-situ sensing and endpoint detection technique with the process optimization schemes to improve process performance.

The wafer-level endpoint for the copper CMP process may be defined as the time when the excess Cu and barrier layers are fully cleared up on a specified number (or percentage) of dies of a wafer. Due to the polishing nonuniformity, all the dies on a wafer generally will not reach the endpoint at the same moment, and some of the dies may be overpolished. Thus the endpoint of CMP can be a representation of the optimal polishing time at which the number of out-of-specs dies (either under- or over-polished) reaches a minimum and the process yield is maximized. However, the remaining Cu thickness on each die area is difficult to measure in real-time to determine the endpoint. Most of the prior art in-situ sensing techniques rely on indirect methods to detect the moment of Cu/barrier clear-up, such as the changes in the friction force, the ion concentrations of the Cu/barrier materials, and the electrical impedance on the surface. However, these methods are limited due to the lack of reliability and the problem of high noise-to-signal ratio in practical applications. Moreover, all these techniques provide only average information over a relative large area (usually wafer-level) and lack the capability of sensing within-wafer and die-level uniformity. Therefore, these methods can just be used as supplementary methods with other primary metrology to assure the detection of endpoint.

Recently, the capability of a photoacoustic technique on the thickness measurement of multi-layer stacked films has been investigated. Two optical excitation pulses are overlapped on the surface of the coating to form an interference pattern. Absorption of light by the film generates counter-propagating acoustic wave. By measuring the acoustic frequency, the film thickness can be calculated. However, this method is limited to a blanket area with the dimensions much larger than the beam size. It is difficult to model the generation and the propagation of the acoustic wave in thin Cu film on the patterned area. Hence, this method is currently limited to the measurements for blanket wafers or large patterns which can be simulated as blanket areas.

Among all the endpoint detection techniques, optical sensing techniques may prove to be the most successful. Interferometry technology is employed to measure the film thickness based on the interference of light from the surface of the top and the underlying layers. This may be suitable for measuring transparent films such as dielectric layers, but not effective for opaque metal films. In theory, the reflectance measurement may be used for detecting the surface topography and the metal area fraction on the surface. Moreover, because the reflectance of patterned surface is influenced by the topography of the pattern, it may also be possible to gain information on surface planarity and dishing by this metrology. While the reflectance technique holds promise, significant development is needed to provide a practical end point detection system and method.

Accordingly, there is a need for an improved method and apparatus that can continuously, and in-situ, monitor localized regions of the wafer surface during the CMP process.

SUMMARY OF THE INVENTION

It is an object of the present invention to provide an in-situ method and apparatus for monitoring localized regions of the wafer surface during the CMP process.

It is another object of the present invention to provide a method and apparatus which continuously monitors the polishing progress at different areas of the wafer, and may also be used to determine the end point for removal of material from the surface of the wafer.

It is a further object of the present invention to provide a method and apparatus which employs the difference in reflectance between different materials on a wafer to monitor the polishing progress and/or end point at selected regions on the wafer surface.

It is yet another object of the present invention to provide a method and apparatus which monitors reflectance at various surface areas of the wafer and controls the polishing process at said areas to achieve substantially uniform removal of metal during polishing.

It is an even further object of the present invention to provide an in-situ method and apparatus for monitoring surface conditions and detecting the process endpoint for cooper damascene CMP.

The foregoing and other objects of the invention are achieved by a chemical mechanical polishing method and apparatus in which a rotating polishing platen and polishing pad of a first diameter polishes a wafer carried by a wafer carrier. A window is formed in the polishing platen and pad whereby said window periodically scans across the underside of the wafer. An optical detector, such as a fiber optic cable, transmits light through the window onto the surface of the carrier and receives light reflectance through the window from said wafer surface as it rotates past the window and means are provided for monitoring the reflected light, and for controlling the polishing process at localized regions of the wafer responsive to the reflected light information.

More specifically, the chemical mechanical polishing method and apparatus includes a wafer carrier that has a membrane having a central and concentric pressure chambers or compartments which define corresponding zones or regions on the wafer surface. An actuator is provided to control the pressure applied to the central and concentric compartments and thereby control the rate of removal of material from the wafer surface at each of the corresponding zones, and the actuator is engaged responsive to reflected light received at each of the zones.

In another aspect of the present invention, a method of chemical mechanical polishing is provided comprising the steps of: providing a CMP machine which includes a polishing pad and a wafer carrier having multiple chambers that allow for independently varying pressure within the chambers that urge against a wafer at corresponding localized regions on the wafer; measuring the reflectance of the surface of the wafer during polishing at each of the localized regions on the wafer; processing the reflectance data to determine the state of polishing within each of the localized regions; and independently adjusting the pressure within any one of the chambers responsive to the state of polishing within each of the corresponding localized regions.

BRIEF DESCRIPTION OF THE DRAWINGS

The foregoing and other objects and features of the invention will be more clearly understood from the following description when read in connection with the accompanying drawings in which.

DETAILED DESCRIPTION OF THE INVENTION

The inventors have discovered a method and apparatus for providing in-situ monitoring of the removal of materials in localized regions on a semiconductor wafer or substrate during chemical mechanical polishing (CMP). In particular, the method and apparatus of the present invention provides for detecting the differences in reflectance between different materials, such as conductive, insulating and barrier materials, within certain localized regions or zones on the surface of the wafer. The differences in reflectance are used to indicate that the top or bulk material has been removed in each of the localized zones. In the preferred embodiment this information is used to provide real-time control of the CMP process.

Figure 1A:
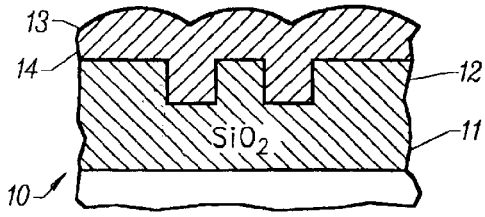
FIGS. 1A and 1B show the surface of a wafer with a trenched oxide coating with conductive interconnect material applied to the surface, FIG. 1A, and polished, FIG. 1B, to leave leads.
Figure 1B:
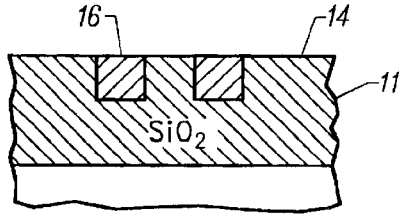
Figure 2:
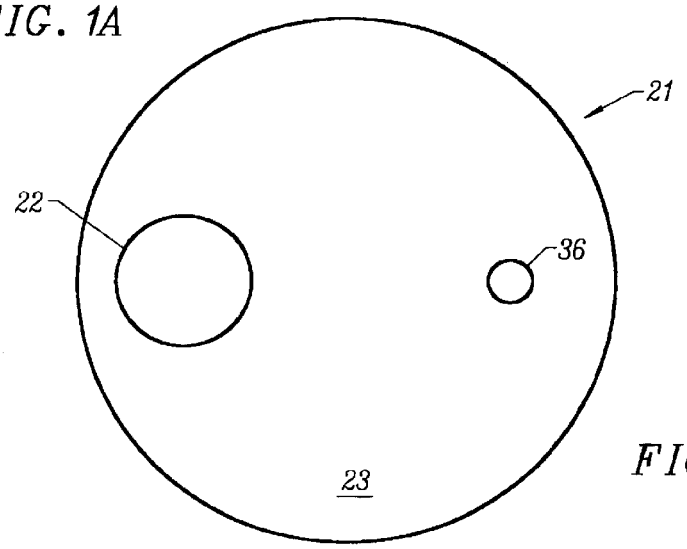
FIG. 2 is a top plan view of a rotating polishing platen and polishing pad with a wafer carrier and observation window in accordance with the present invention.
Figure 3:
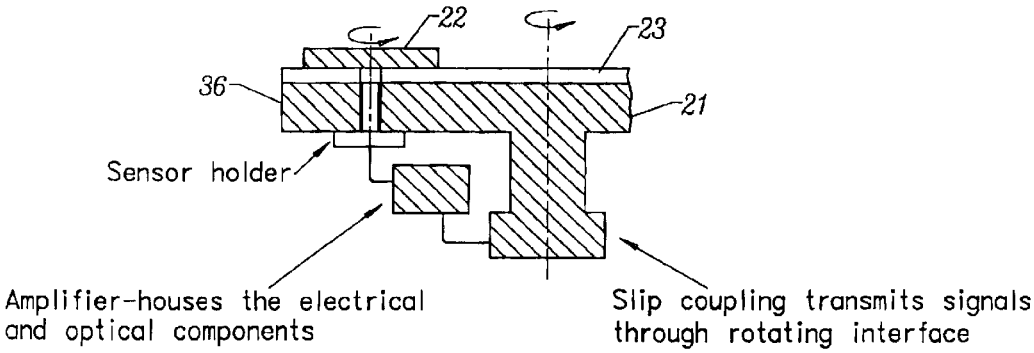
FIG. 3 is a partial sectional view showing the rotating polishing platen, polishing pad and wafer carrier in accordance with the present invention.

Specifically, referring to FIGS. 2 and 3 is shown a portion of a CMP machine which includes a rotating platen 21 and a rotating wafer 22 carried by a wafer carrier (not shown) in accordance with one embodiment of the present invention. The platen 21 carries a polishing pad 23 onto which a polishing slurry is applied during the CMP process. The CMP machine in the present embodiment is employed to remove surface material, either a conductive or insulating material, from the surface of the wafer. In one embodiment, the surface material is a metal, and the metal is removed from the wafer surface to leave conductors imbedded in trenches in an insulating layer. The conductive material can be any suitable conductor such as aluminum or copper. The insulating material can be any suitable insulator such as un-doped silicon dioxide, silicon oxide doped with boron, phosphorous, or both, or low dielectric constant materials. Also, the present invention may be used to remove conductive or insulating materials to expose a barrier material, such as TaN and the like. Further, the barrier layer may also be removed. In one embodiment the present invention is directed to a method for detecting surface metal removal to fabricate a structure such as that schematically illustrated in FIG. 1B. The present invention exploits the reflective differences between the conductive (typically metal) and the insulating materials to monitor the progress of planarizing of the wafer, and to determine which localized regions are nearing removal of the material and thus the end point of the polishing process.

Figure 8:
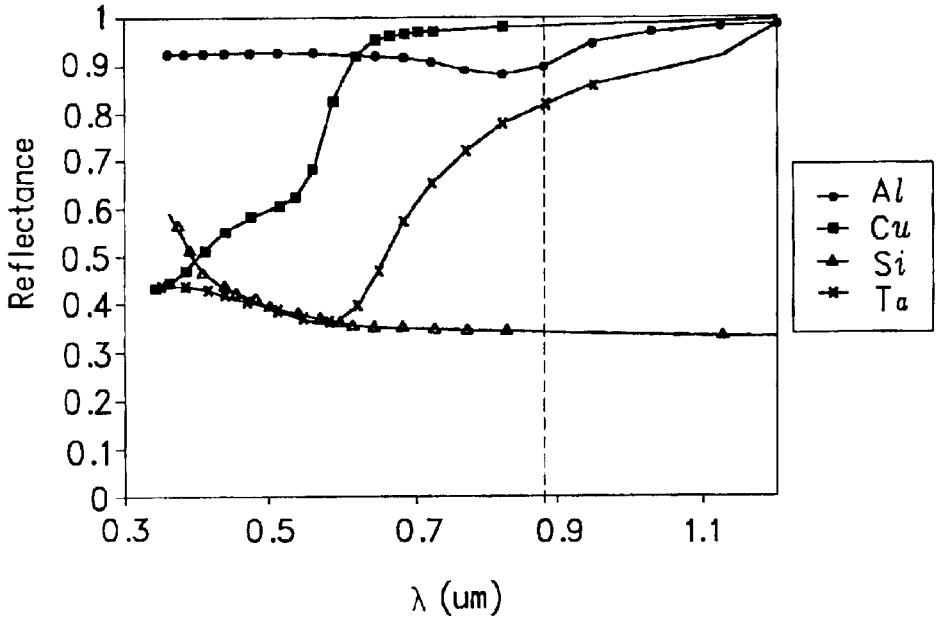
FIG. 8 shows reflectance as a function of wavelength for various materials.

To monitor the CMP process, the difference in reflectance between the conductive and the insulating materials are observed. The preferred conductive materials used for leads in semiconductor devices are aluminum and copper, which are approximately 90–95% reflective for light around one micrometer in wavelength. The reflectance as a function of wavelength for copper, aluminum, silicon and tantalum are shown in FIG. 8. Most insulating materials such as silicon oxide are, as can be seen from FIG. 8, 25–30% reflective at the same wavelength. This difference in reflectance is used to monitor the polishing process. During the CMP process, the pre-polished reflectance from the wafer surface is expected to be about 90% due to full coverage of metal on the surface of the wafer. Upon completion of the CMP process the post-polish reflectance is expected to be lower; in one example in the range of about 25–60%, because the exposed surface has a mixture of insulating material and the metal conductors in the trenches. It is important to note that the these numbers are given for general purposes only, and that the actual different in reflectance between the conductive and insulating or barrier materials will vary primarily based on the type of material and on the pattern and pattern density on the surface of the wafer. In general, lower the density of the metal lines on the patterned wafer, the lower the reflectance value. In one exemplary embodiment of the present invention, the difference in reflectance between the conductive material, and the reflectance value which indicates that the CMP process is nearing completion or is substantially complete at a given zone, is observed to be up to about 65%. Again, the actual difference in reflectance will vary dependent on a number of factors, such as for example the type of material, whether the material is in bulk or patterned, the pattern density, the wavelength of the light, and the surface finish of the wafer (which may reduce the reflectance).

Figure 6:
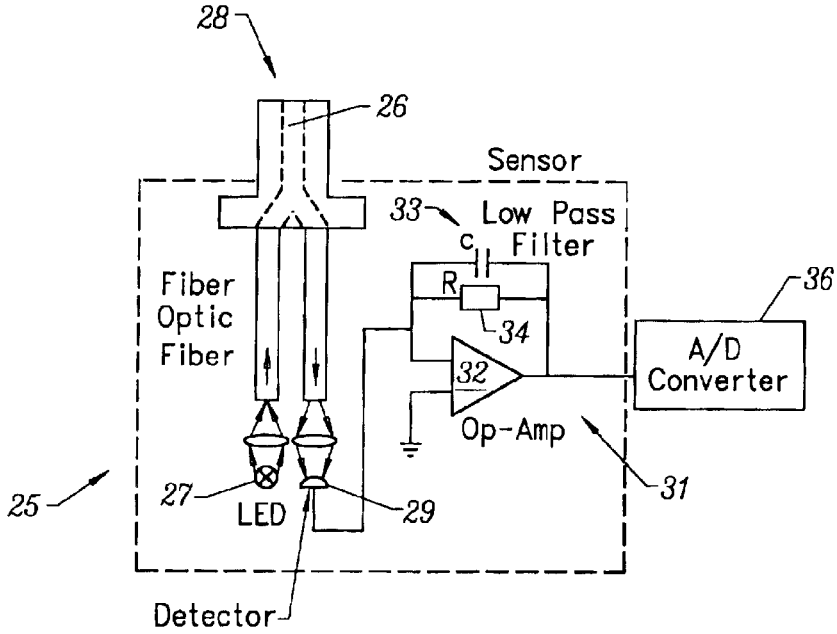
FIG. 6 is a schematic of the optical end point detection system according to one embodiment of the present invention.

An optical detection system, preferably a fiber optic reflectance system, is used in the present invention. Referring to FIGS. 3 and 6, one example of the present invention shows a bundle 26 of optical fibers which transmit light from a light source 27 such as a light-emitting diode, to a sensor tip 28. Other optical fibers in the bundle 26 transfer light reflected from the surface of the wafer to a photodetector 29 connected to an amplifier system 31 including an operational amplifier 32 and low pass filter comprising capacitor 33 and resistor 34. The analog output from the operational amplifier is applied to an analog-to-digital converter 36, and then to a processing system which processes the digitized signal in a manner to be presently described. Such an fiber optic system is commercially available, such as a Philtec D64 sensor system In the preferred embodiment, the emitting and receiving fibers are in parallel and are randomly distributed in the bundle 26 and oriented generally normal to the wafer surface, although other orientations are acceptable. According to the present invention, the light-emitting diode is selected to emit light at a wavelength that maximizes the differences in reflection of the particular materials on the surface of the wafer. In one example, where a copper layer is to removed to reveal copper leads placed within intervening silicon dioxide layers, the light-emitting diode is selected to emit light at a wavelength of preferably about 880 nm, which is in the range having optimal differences in reflection. Those skilled in the art will recognize that the wavelength providing the most optimal difference in reflectance between the conductive and insulating materials will vary depending on the types of the materials, but that such wavelengths can be determined based on the teaching of the present invention.

The gap distance "g" between the sensor tip 28 and the wafer 22 is important to minimize fluctuations in the reflectance readings. Accordingly, preferably the sensor holder of the present invention is designed to allow gap adjustment. In one example, the sensor holder is comprised of a rigid housing with a nut which receives a threaded sensor tip that screws onto the nut and the gap between the sensor tip 28 and the wafer is adjusted up or down simply by twisting. Other sensor holder configurations may be used so long as they provide a rigid structure that allows adjustment relative to the wafer surface.

Figure 7:
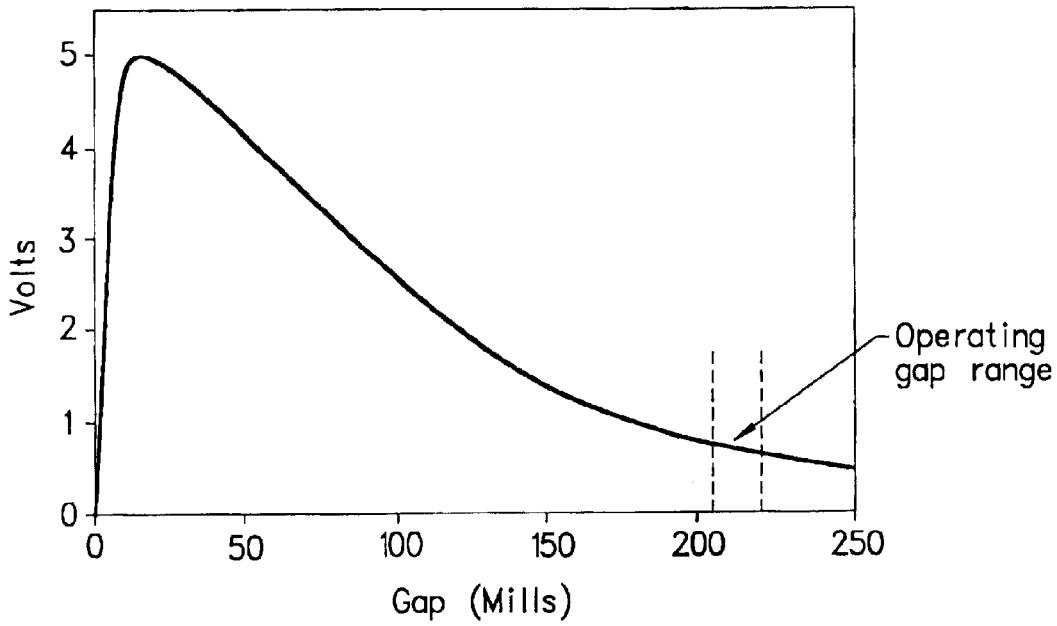
FIG. 7 shows the output voltage as a function of the gap between the end of the fiber optics bundle and the wafer surface for one exemplary embodiment of the present invention.

Increasing the gap distance "g" can minimize the influence of gap changes as illustrated in FIG. 7 which shows the characteristics of the sensor of the exemplary embodiment. Specifically, each sensor will exhibit a certain voltage at a certain gap distance, as can be determined experimentally or may be available form the manufacturer of the sensor. It is preferred to select a gap distance where the slope of the curve flattens out. In the exemplary embodiment, using a Philtec sensor the gap distance "g" is preferably in the range of about 200 to 250 mils, and more preferably in the range of about 200 and 225 mils. While, one specific example is shown, other suitable sensors may be used to measure reflectance of a wafer surface. However, any suitable sensor must be capable of projecting light onto the wafer and gather the reflected light, and providing an output signal for processing.

To provide in-situ monitoring of the CMP process, the method and apparatus of the present invention employs the sensor tip, inserted in at least one window 36 formed in the rotating platen, to view the wafer during polishing as shown in FIG. 3. The fiber optics bundle with the light emitting diode detector and amplifier are mounted for rotation with the platen. A suitable slip coupling (not shown) may be used to transmit the analog signals through a rotating interface to the analog-to-digital converter 36. More than one window may be formed in the rotating platen, each having a sensor tip inserted therein for viewing multiple locations at the same time. When using multiple sensors, sampling techniques known in the art may be used to process the signal. The window may be of any shape and size, and is limited only by being able to adequately house the sensor tip, an preferably provides a small footprint to minimize the impact on the polishing process.

Figure 5:
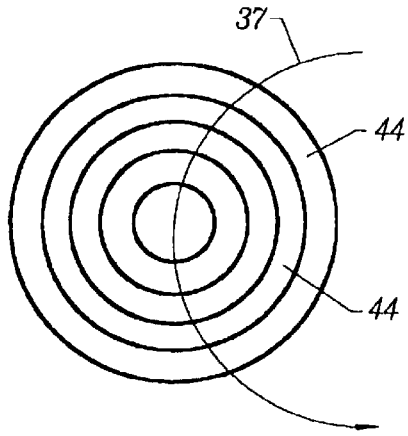
FIG. 5 schematically shows the wafer surface with concentric annular areas and the path of the scanning window across the wafer according to the present invention.

Of particular advantage, the window 36 may be placed in any desired location such that it traverses a desired region of the wafer during polishing. In the preferred embodiment, the center-to-center offset distance of the wafer and the window are selected such that the sensor tip views the wafer in a scanning arc which travels through the center of the wafer. The scan line 37 shown in FIG. 5 illustrates one example of the scanning arc which travels through the center of the wafer. The polishing may be axis-symmetric, and thus a measure of the reflectance intensity at a distance from the wafer center is expected to be the same for all zones of equal radii. In the instance when polishing is axis-symmetric, the polishing level can be inferred for all other radii in any annular zone, as long as the sensor traverses across the center of the wafer.

Alternatively, different scanning arc trajectories may be selected by changing the center-to-center offset and/or by varying the rotational speeds of both the wafer carrier and the platen. For example, up to a 10% rotational speed offset (i.e. difference in speed between the wafer carrier and the platen) allows one to "step" the trajectory across the wafer.

The optical detection system needs to be protected from the polishing environment. This is accomplished by providing the window(s) 36 in the polishing pad 23, flush with or slightly recessed from the pad surface. Preferably, the window has similar wear properties as those of the pad thus preventing any damage to the surface of the wafer.

Figure 4:
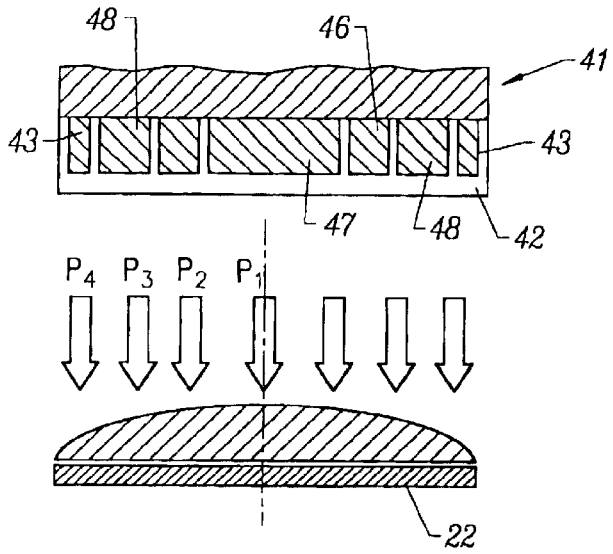
FIG. 4 shows the diaphragmed pressure pad of the wafer carrier associated with a metalized wafer in accordance with one embodiment of the present invention.

Of significant advantage the present invention provides for monitoring the CMP process in certain localized regions or zones. In particular, a plurality of zones are defined on the surface of the wafer and correspond to zones formed in a membrane that engage the wafer. Preferably, the zones are annular; however, the zones may be formed of any suitable shape. Referring to FIGS. 4 and 5, one example of these zones are schematically illustrated, and are further described in co-pending application Ser. No. 09/628,563 wherein a wafer carrier with compartmentalized membranes engages the upper surface of the wafer and urges the wafer across the polishing pad. In this example, the compartments or chambers are in the form of concentric rings and define annular zones whereby the pressure between the wafer and the polishing pad is controlled by these annular zones which are adjacent to the wafer. Thus, by varying the pressure in the annular zones, the rate of polishing on the wafer is controlled at localized regions on the wafer corresponding to each of the annular zones.

More specifically, as further described in the above referenced co-pending application, a wafer carrier is provided which includes a flexible membrane that engages the wafer and urges or presses the wafer against the polishing pad. FIG. 4 schematically illustrates such a wafer carrier 41 which includes a membrane 42 having concentric compartments 43 formed therein and sealed which define the multiple chambers or cavities 46. The chambers 46 form concentric rings with a center chamber 47 surrounded by one or more outer chambers 48. These chambers are defined as annular zones or regions. Each of the chambers separately engage the undersurface of the wafer 22, and thus define localized regions on the wafer surface corresponding to the adjacent annular zones. The pressure applied to the wafer 22 is separately controlled by the pressure in each of the chambers as indicated the arrows $P_1$–$P_4$ in FIG. 4. The result is that concentric zones or regions 48 on the wafer surface can be polished at different rates by controlling the pressure in the corresponding chambers 46. Although four zones are shown in the figures, any suitable number of two or more zones may be defined. Further, the zones may be of a different shape and are not limited to an annular shape, although an annular shape is preferred for the outer zones. In the preferred embodiment, the membrane contains four chambers defining four zones, the four zones being comprised of one circular center zone and three annular concentric zones.

As the sensor traverses across the wafer during polishing, it monitors the polishing progress in the area of the wafer corresponding to one or more of the concentric surface zones. Non-uniform removal of material on the wafer surface tends to occur in patterns concentric about the central normal axis of the wafer due to the rotation of the wafer during polishing. The sensor detects the condition of the wafer a given distance away from the center, and a similar reflectance measurement may be assumed for all equal radii. As described in further detail below, this information regarding the condition of the wafer surface in the different zones is transmitted to a control system to produce a control signal which then selectively controls the pressure in the corresponding chambers behind the wafer as needed to selectively reduce wafer level non-uniformity during the CMP process.

Additionally, the sensor is sensitive to scattering effects due to topographic variations found on the surface material layer on the wafer, particularly when the surface material is copper, just before planarization or removal of the layer. These topographic variations are expected to become more planar during polishing and prior to removal, resulting in an increased reflectance signal. According to one embodiment of the present invention this information is used to ascertain the wafer surface planarity during polishing, and is then used to modify the process parameters to provide more effective and/or efficient polishing. Initially, low pressure gives better planarization and as planarity is reached as indicated by an increased reflectance signal, the process may be modified to higher pressure and velocity to give an increase in removal rate. Thus, the overall polishing time may be reduced. Thus, the present invention provides a method and apparatus for providing feedback control to adjust the CMP process parameters, in addition to monitoring the CMP process.

Figure 10:
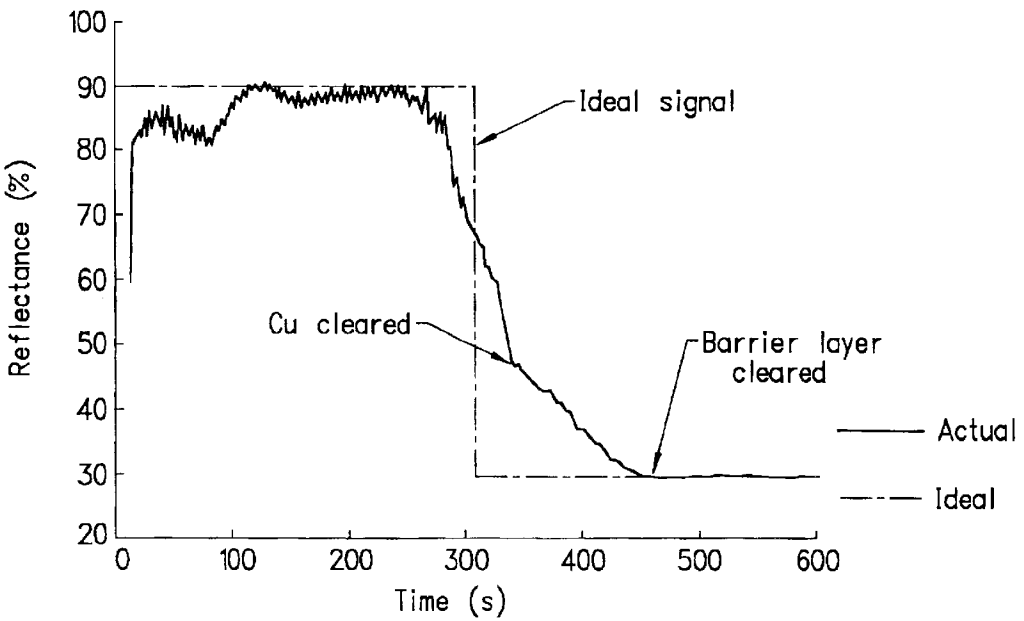
FIG. 10 illustrates one example of actual reflectance as a function of time as compared to an ideal signal.

In another aspect of the present invention, the desired end-point of the CMP process is detected in-situ during polishing. A variety of methods may be used to monitor the CMP process and to determine the end-point. In one example, the end point of the CMP process is determined by comparing the sensor signal to a predetermined threshold value. Referring to FIG. 10, there is a comparison of the ideal signal and an actual signal obtained during removal of a metal coating (copper blanket wafers). It is seen that there is a measurable drop in reflectance as first, the conductive copper layer is removed, and second when the barrier layer is removed. Experimental results have shown a reasonable correlation between the ideal sensor signal and the actual sensor signal. Accordingly, a threshold reflectance value can be determined for each type of material and pattern type which can be used to compare against actual signals received during processing. When the threshold value is met in a given zone, pressure to the corresponding membrane chamber is reduced or removed to prevent further polishing in that region.

Further, in addition to the threshold value, the entire pressure profile within each zone from the last wafer run can be used to control the next wafer. This control system is referred to as a "feed forward" or run-to-run" control system. This type of system assumes that the nest wafer to be polished will exhibit similar topology and material removal characteristic within the same location or zone as the previous wafer. Thus, a similar pressure profile is applied to the chambers to carry out a similar polishing process.

Figure 9:
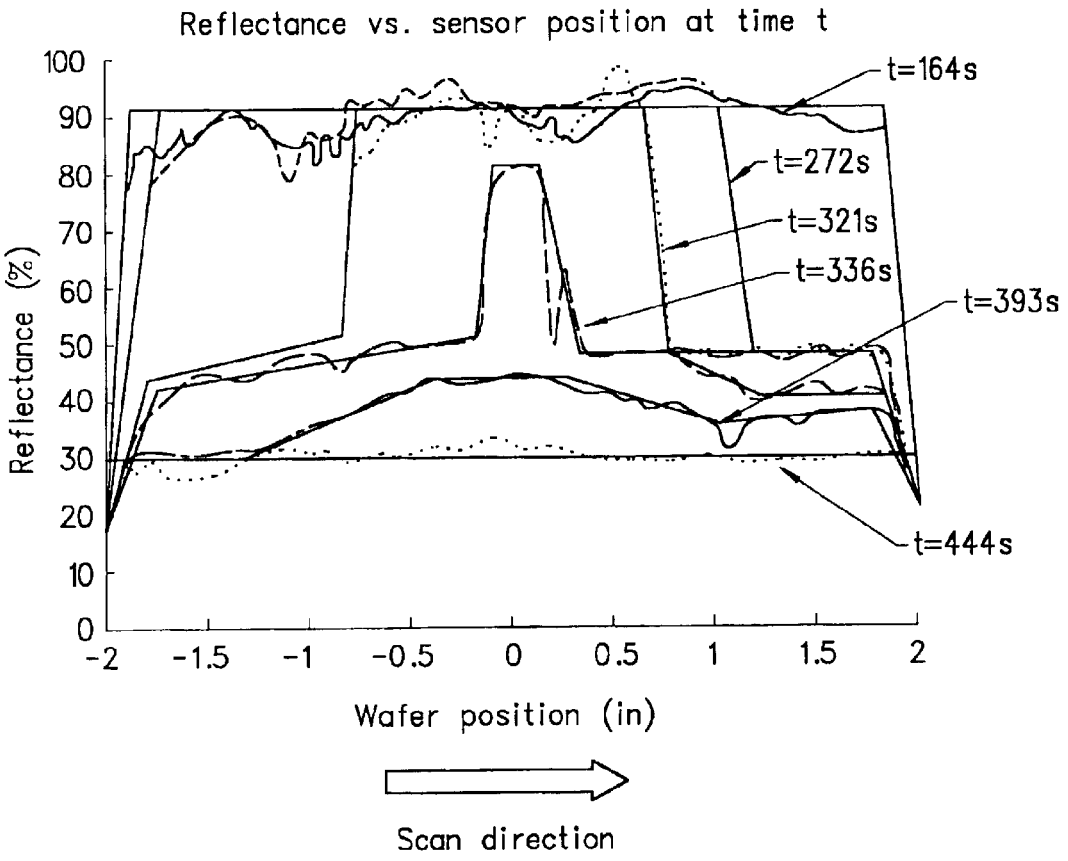
FIG. 9 shows the reflectance as a function of wafer position at various polishing times for one exemplary embodiment of the present invention.

FIG. 9 exhibits experimental results for tests conducted using the method and apparatus of the present invention. Wafers were polished having a blanket copper layer. The polishing took place until the blanket copper layer was removed to reveal a barrier layer of TaN. FIG. 9 plots the reflectance received as a function of the wafer position (in inches) for multiple polishing passes in time (t) over the wafer. A number of observations can be made. First, the material removal does occur substantially axis-symmetrically about the center of the wafer. The center of the wafer is the last localized region to be polished, and the edges of the wafer polish faster than the other regions of the wafer. This information can be used to create a pressure profile as described above, and sued to provide feed forward or run-to-run control. Specifically, the pressure is varied within each of the chambers corresponding to the localized position (i.e. zones) on the wafer to achieve the desired material removal. For example, the pressure in the outermost chambers which correspond to the edges of the wafer will be reduced at a selected time into the polishing process to account for the faster material removal rate in this region. The pressure may be reduced gradually, so that this region continues to be polished, but at a slower rate. Alternatively, the pressure may remain constant but will be at a lower value in this zone. Conversely, the center chamber which corresponds to the center position (or zone) of the wafer may receive increased pressure, the pressure may remain constant throughout the entire process, or a combination of both techniques may be used, since the center is the last zone to polish in this particular example.

Figure 11:
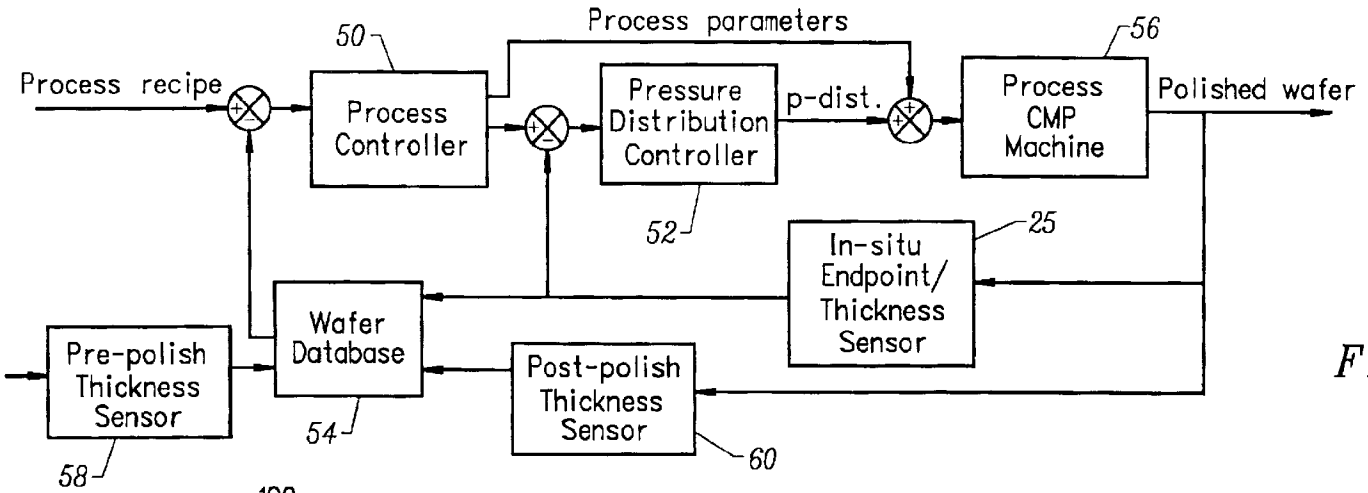
FIG. 11 is a schematic block diagram of a control loop for one example of a chemical mechanical polishing apparatus that may be used with the present invention.

FIG. 11 shows a block diagram of one example of a control system that may be used with the present invention. The control system is comprised primarily of a process controller 50, pressure distribution controller 52, sensor 25, and a wafer database 54. The process controller 50 receives data establishing the process parameters or recipe, and sends commands to the CMP machine 56 to control the CMP process. Additionally, coupled to the process controller 50 and the CMP machine 56 is the pressure distribution controller 52 which controls the pressure within the membrane chambers in the wafer carrier as described above.

The pressure distribution controller 52 receives data via two routes. First, the pressure distribution controller 52 may receive data representative of the reflectance measurements in each of the zones on the wafer directly from the sensor 25. The pressure distribution controller 52 includes hardware and software configured to receive the reflectance measurements, determine the appropriate pressure adjustment needed (if any) within each zone, and then sends a signal to the CMP machine to selectively adjust the pressure within the subject zone as appropriate. The reflectance data from the sensor is also transmitted to, and stored in, the wafer database 54.

In an alternative embodiment, predetermined pressure profile values and/or threshold values for each of the zones are stored in the wafer database 54. These values are then transmitted to the process controller 50 or the pressure distribution controller 52. The pressure distribution controller compares these values to the actual, real-time reflectance values from the sensor 25 and sends a signal to the CMP machine 56 to adjust the pressure in each of the zones as appropriate. Additional data, such as the pre-polish thickness of the wafer 58 and/or the post-polish thickness of the wafer 60 may be sent to the wafer database to assist in determining the appropriate pressure adjustment.

In another embodiment of the present invention, model based detection may be used to monitor and control the CMP process. Specifically, model based control provides for the real time adjustment of the CMP process parameters to better tailor the CMP process to the most effective and efficient process. The detection systems described above focus primarily on selectively controlling the pressure in the zones to provide for substantially uniform polishing of the localized regions of the wafer. This minimizes the occurrence of over-polishing in some regions and under-polishing in other regions.

The model based detection and control system evaluates the amount of scattering in the reflectance signal received from the sensor. As described above, the inventors have found that the degree of scattering is indicative of the topography of the surface layer on the wafer. The extent of scattering of the signal may be evaluated based on statistical techniques such as determining the standard deviation and the variation in the mean as well as the shape of distribution. When a high level of scattering is seen the CMP process can be adjusted to give better planarization. As planarization proceeds, the surface layer the topographical variations begin to flatten out, and the scattering of the signal decreases. As this occurs the CMP process can again be adjusted to increase the removal rate of material from the surface of the wafer. These process adjustments can be made for example, by varying the relative velocity and applied pressure process parameters, and such adjustments can be made selectively within each of the zones as appropriate. Thus, the degree of scattering of the reflectance signal can used as an indicator of the material removal rate, and the polishing state of the wafer at certain localized regions on the wafer, and this information can be used to adjust the CMP process parameters.

In another aspect of the present invention, a method of chemical mechanical polishing is provided. In general, the method comprises the steps of: providing a CMP machine which includes a polishing pad and a wafer carrier having multiple chambers that allow for independently varying pressure within the chambers that urge against a wafer at corresponding localized regions on the wafer; measuring the reflectance of the surface of the wafer during polishing at each of the localized regions on the wafer; processing the reflectance data to determine the state of polishing within each of the localized regions; and independently adjusting the pressure within any one of the chambers responsive to the state of polishing within each of the corresponding localized regions.

Figure 12:
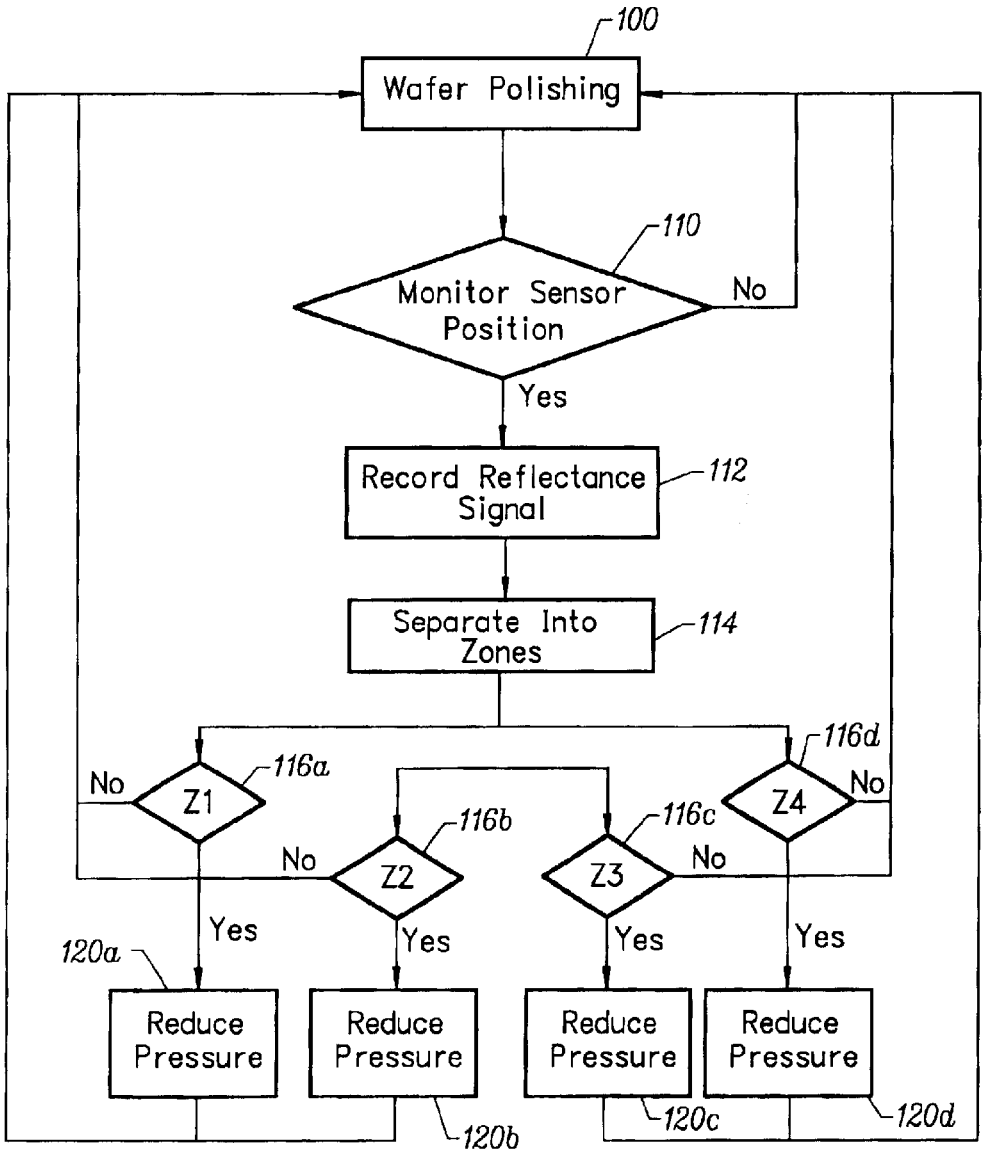
FIG. 12 is a flow chart illustrating processing of the output signal from the reflectance sensor for one embodiment of the present invention.

More specifically, in one embodiment the method of the present invention may be carried out as illustrated by the flowchart of FIG. 12. A CMP machine is provided and wafer polishing begins at step 100. The CMP machine includes means for varying the pressure against the wafer at localized regions, such as the flexible membrane having chambers that define zones on the wafer as described above. It should be noted however, that the present invention is not limited to this particular configuration, and other means that provide for independent control of the pressure at localized regions of the wafer may be used.

To provide for localized control of the pressure, and therefore localized material removal rate on the wafer, the sensor position is monitored at step 110 using conventional means. The reflectance signal is measured and recorded at step 112. At step 114 the signal measurements are separated into zone. The reflectance signal for each of the zones is then processed at step 116*a*–116*d*. As described above, processing of the signal may be performed in a variety of ways. For example, the reflectance signal may be compared to a threshold value or to a pressure profile. Based on the output of the processing of the signal at steps 116*a*–116*b*, a decision is made at step regarding whether the pressure needs adjusting in any one of the localized zones. The inquiry is made for each of the zones at steps 116*a*–116*d* (four zones in the exemplary embodiment), and the pressure is reduced when the inquiry is positive at steps 118*a*–118*d*.

Figure 13:
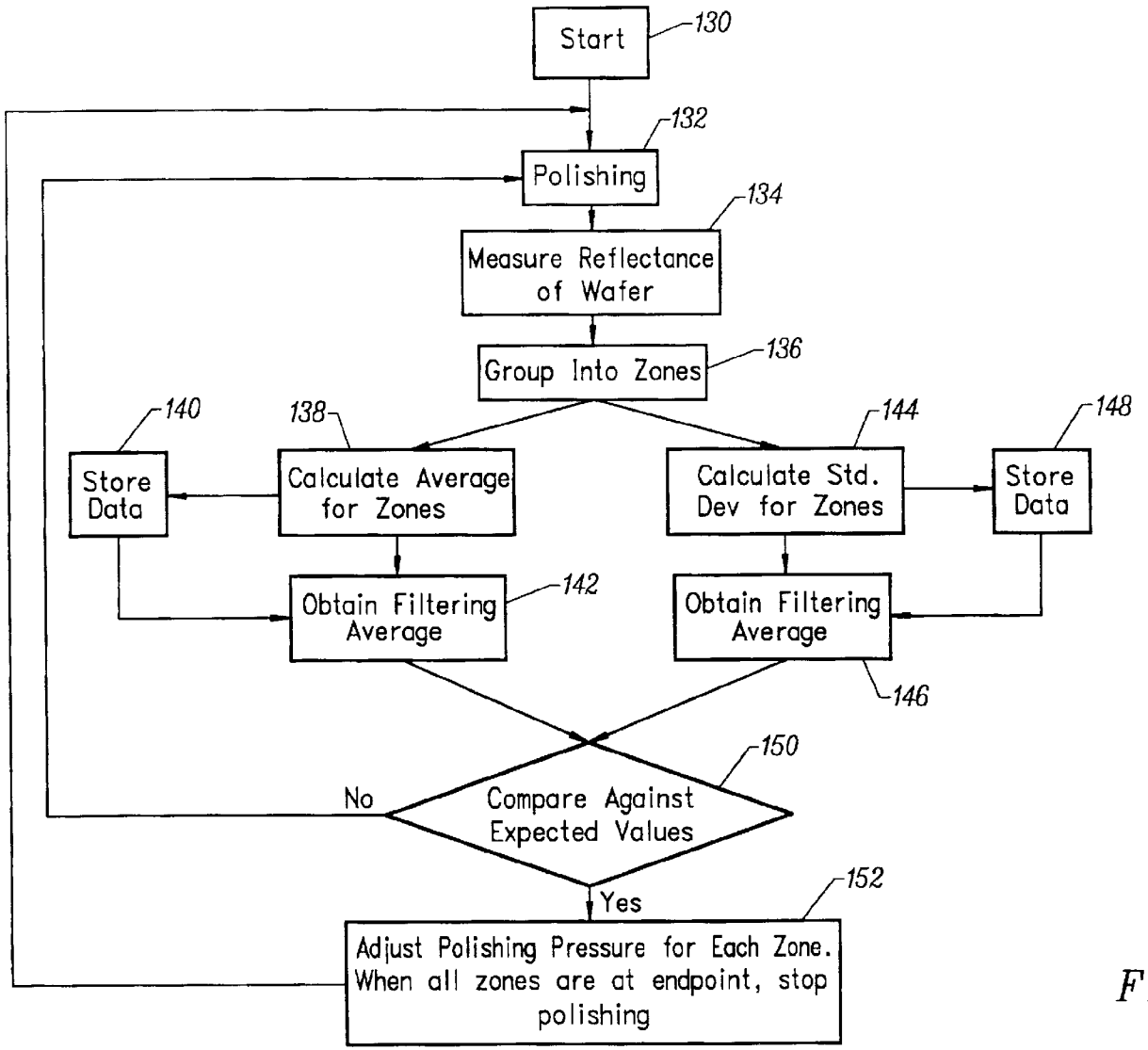
FIG. 13 is a flow chart illustrating the control of pressure at the various wafer zones in accordance with an alternative embodiment of the present invention.

FIG. 13 shows the method, particularly the processing step, in greater detail. The method begins at step 130 with polishing of the wafer at step 132. During polishing, the reflectance at various zones on the wafer is measured at step 134. The reflectance data measurements are separated or grouped into zones depending on the position of the sensor when the data was gathered at step 136. The grouped data is then individually processed. In one example, the grouped data is processed to calculate the average reflectance in each of the zones at step 138, data is stored at step 140, and a filtering average is obtained at step 142. The same reflectance data is also processed to calculate the standard deviation of the data in each of the zones, and to obtain the filtering average at steps 144 and 146. The standard deviation data is stored at step 148. The moving average values from both processing steps 142 and 146 are compared against previous, expected or threshold values at step 150. If the values do not differ in any of the zones, the polishing process continues without adjustment. If the values do differ in any one or all of the zones, the pressure in the zone(s) is independently adjusted accordingly at step 152. When all of the zones exhibit reflectance data that is indicative of end-point (as compared to previous, expected or threshold values) then the polishing process stops.

In another aspect of the present invention, surface conditions on the wafer are determined, and in particular as shown in the exemplary embodiments, the surface conditions on blanket and patterned cooper wafers are evaluated.

Figure 14:
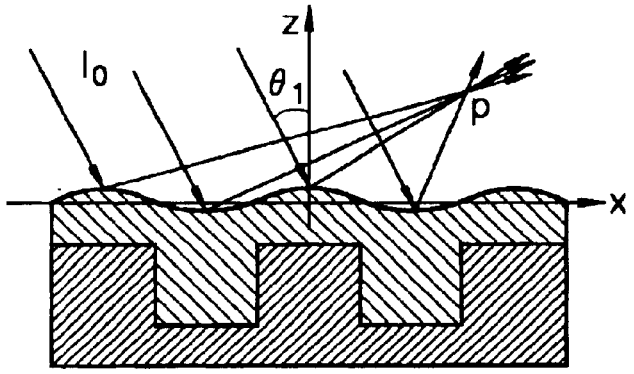
FIG. 14 shows a schematic diagram of light scattered on a patterned Cu surface.
Figure 15A:
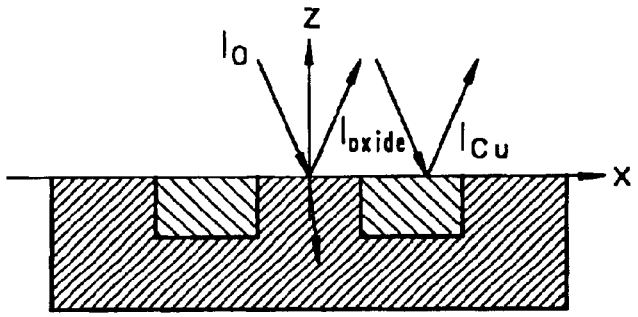
FIGS. 15*a* and 15*b* show schematic diagrams of light scattered from (a) a planar composite surface, and (b) a wavy composite surface.
Figure 15B:
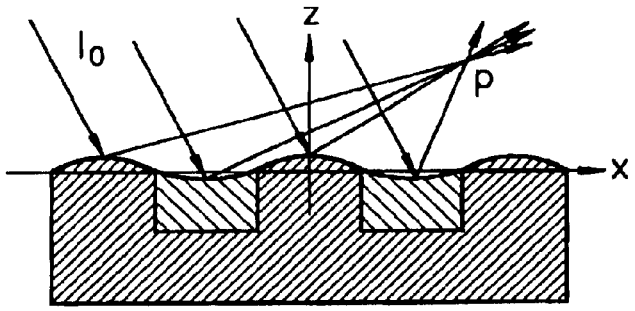
Figure 16:
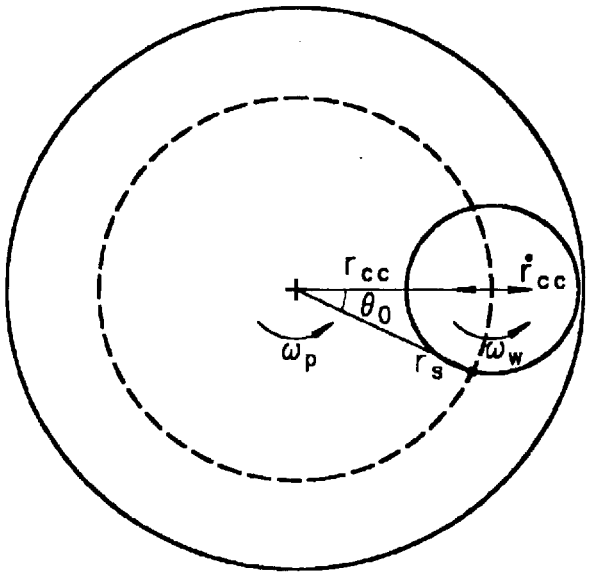
FIG. 16 illustrates sensor kinematics in accordance with one example of the present invention.

The scattering of light by a periodic wavy surface as shown in FIGS. 14, 15*a* and 15*b* has been investigated by many researchers (Rayleigh, 1907; Eckart, 1933; Beckmann and Spizzichino, 1963; Uretsky, 1965; Desanto, 1975 and 1981). The important formulations and their solution are reviewed in this section for the purpose of understanding the effects of pattern geometry on the surface reflectance by scattering. Consider the problem of plane wave being scattering by a periodic surface S, where z=h(x), as shown in Equation 1. Let $E_1$ and $E_2$ denote the incident and scattered fields. The incident light (electric) field $E_1$, assumed to be unit amplitude, can be expressed as $$E_1=\exp\left[(k_1 \sin\theta_1 x-k_1\cos\theta_1 z)-iwt\right]; \tag{1}$$

where $k_1$ is the wave number of the incident light wave ($k_1=2\pi/\lambda$), $\theta_1$ the incident angle, $\omega$ the angular frequency ($\omega=2\pi f$), and t the time. If only the scattered field at a fixed time is concerned, the $\exp(-i\omega t)$ can be further suppressed for simplicity. The scattered field $E_2$ at any point P of observation above the surface is given by the Holmholtz integral (Beckmann, 1963)

$$E_2(P)=\frac{1}{4\pi}\int\int_S\left(E\frac{\partial\psi}{\partial n}-\psi\frac{\partial E}{\partial n}\right)ds \tag{2}$$

with $$\psi=\exp(k_2 r)/r \tag{3}$$

where r is the distance between the given observation point P and any point on the surface (x, h(x)), and $k_2$ is the wave number of the scattered wave ($k_2=k_1=2\pi/\lambda$). The point P is assumed in the Fraunhofer zone, i.e. $r\rightarrow\infty$, to focus on the plane scattered waves rather than spherical ones. In order to solve the scattered field $E_s$ in Equation 2, the total field E and its normal derivative $\partial E/\partial n$ on the boundary surface must be can be specified, which can be approximated as ("Kirchhoff's method")

$$(E)_S=(1+\gamma)E_1 \text{ and} \tag{4}$$

$$\left(\frac{\partial E}{\partial n}\right)_S=(1-\gamma)E_1(k_1\cdot n)=(1-\gamma)E_1\left(k_1\sin\theta_1\frac{\partial h(x)}{\partial x}-k_1\cos\theta_1\right) \tag{5}$$

where $\gamma$ is the reflection coefficient of a planar surface, and n is the unit vector normal to the surface at the interested point. The reflection coefficient $\gamma$ depends not only on the local angle of incidence and the electrical properties of the surface material, but also on the polarization of the incident wave. For simplicity, the surface is assumed to be perfectly conducting, i.e. $\gamma=-1$ for a horizontal polarization (electric vector perpendicular with the incident plane) for the following analysis.

Equation 2 can be integrated over a specified periodic surface profile, such as a sinusoidal surface pattern.

$$z=h(x)=(\Delta h)\cos(2\pi x/\Lambda), \tag{6}$$

where $\Lambda h$ is the half step-height and $\Lambda$ the pitch of the features. The scattered field will also follow the same period $\Lambda$ along the x direction, which help simplified the integration term in Equation 2 by calculating the integration within one period instead of over the entire surface. Moreover, periodicity of the problem implies that the scattered field can be written as a superposition of the Fourier series representing the plane waves at different modes, in which the reflective (scattering) angle of each mode $\theta_{2m}$ follows the relation (grating equation).

$$\sin\theta_{2m}=\sin\theta_1+m\lambda/\Lambda\ (m=0, \pm1, \pm2, \ldots) \tag{7}$$

The zero mode represents the condition of specular reflection, in which $\theta_2=\theta_1$, and the direction of the scattered plane wave will be away from the specular angle for larger m. The solution for the scattered field at the primary direction of each mode $\theta_{2m}$ at far field can be obtained by applying Equations 3, 4, 5, 6 and 7 into Equation 2 and performing integration over the surface ($-L\leqq x\leqq L$). The reflection coefficient y is written as a function of optical properties of the coating and the local angle of incidence to calculate the integration. The result can be normalized by the field reflected on a specular planar surface $E_{20}$, which defines the scattering coefficient $\phi(=E_2/E_{20})$, and can be written as (Beckmann, 1963)

$$\phi(\theta_1, \theta_{2m})=-\sec\theta_1\frac{1+\cos(\theta_1+\theta_{2m})}{\cos\theta_1+\cos\theta_{2m}}(-i)^m J_m(s)+C_1(n_1) \tag{8}$$

where J is the Bessel function, $S=2\pi\Delta h/\lambda(\cos\theta_1+\cos\theta_2)$, and $n_1$ the residual parts of the ratio $L/\Lambda$. Equation 8 just gives the scattering coefficient at the primary scattering angle of each mode. For all the direction at angle $\theta_2$, the results is given as $$\phi(\theta_1, \theta_2)=-\frac{\sin 2np\pi}{2n\sin p\pi}\sec\theta_1\frac{1+\cos(\theta_1+\theta_2)}{\cos\theta_1+\cos\theta_2}e^{-ip\pi}\left[J_{-p}(s)+\frac{\sin p\pi}{\pi}\int_0^\infty e^{\sigma t\,0s\sinh t}dt\right]+C_2(n_1) \tag{9}$$

where $p=(L/\lambda)(\sin\theta_1-\sin\theta_2)$, $s=2\pi\Delta h/\lambda(\cos\theta_1+\cos\theta_2)$ and n the integer parts of the ratio $L/\Lambda$. In the far field (Fraunhofer zone, i.e. $r\rightarrow\infty$), only one mode of scattered plane wave can be observed at the given point P (in the direction of $\theta_2$), as shown in Equation 1. As shown in Equation 1 in the near field, or the Fresnel zone, the total scattered field at P, normalized by $E_{20}$, is given by superposing all the scattering modes contributed from the neighboring periodic surface. Both the amplitude and the direction of each mode, given by Equations 8 and 9, and the phase difference between each mode must be considered to calculate the total scattered field. In practice, the calculation of the total scattered field may be complicated and needed to be performed numerically for the sensor located near the measured surface. It was shown that diffusion scattering takes place when the $\Delta h/\lambda$ ratio increases with constant pitch $\Lambda$ (Brekhovskikh, 1952). Light will be scattered away from the direction of specular reflection, i.e., light is reflected into the direction of higher scattered modes (larger m), and will not be received by the sensor. Therefore the surface reflectance, which is proportional to the square of amplitude of the reflecting field, decreases with the step-height of the feature $\Delta h$ with $\Delta h$ comparable or larger than the wavelength of incident light. On the contrary, when the surface is planarized, i.e. $\Delta h\approx 0$, the surface reflectance will be close to that of a specular surface. Moreover, based on the law of energy conservation, the overall scattering coefficient $\phi$ should be always equal or less than unity.

It is noted that the number of possible modes m for the scattering field is limited by the condition that $\alpha_n = \sin\theta_n$ should be less than unity. If $2\pi/kL$ (or $\lambda/L$) is close to unity, i.e. the wavelength is close to the waviness of the pattern, there will be one mode only and the surface will reflect specularly regardless its roughness. For the submicron Cu patterns employed in current design, the reflectance measured at the onset of process endpoint by a light source with comparable or larger wavelength essentially will indicate the Cu area fraction only. The slight surface topography due to overpolishing and dishing will not affect the reflectance significantly. As shown in Equation 2, the surface reflectance R, proportional to the square of the reflection coefficient, of the composite surface at the onset of endpoint therefore can be written as $$R = A_f R_{Cu} + (1 - A_f) R_{oxide} \tag{10}$$

where $A_f$ is the area fraction of Cu interconnects, and $R_{cu}$ and $R_{oxide}$ the reflectances of Cu and TEOS, respectively, in specular reflection.

The sensor loci on the rotating wafer surface can be determined by the relative velocity of the sensor to the wafer and the initial position of the sensor, as shown in Equation 3. The relative velocity of the sensor on the rotating wafer can be obtained by the two steps: find the relative velocity of the sensor to the stationary X, Y coordinates fixed at the center of the wafer and then performing a coordinate transformation with respect to the wafer rotation. The velocity components for the sensor, $v_{X,s}$, and $v_{Y,s}$, and the wafer, $v_{X,w}$, and $v_{Y,w}$, in X, Y coordinates can be expressed as shown in FIG. 2.

$$v_{X,s} = -r_s\omega_p \sin(\omega_p t + \theta_0) - \dot{r}_{cc} \tag{11a}$$

$$v_{Y,s} = r_s\omega_p \cos(\omega_p t + \theta_0) \tag{11b}$$

and $$v_{X,w} = -r_s\omega_w \sin\theta \tag{12a}$$

$$v_{Y,w} = \omega_w(r_s \cos\theta - r_{cc}) \tag{12b}$$

where $r_s$ is the offset of the sensor from the center of the platen, $r_{cc}$ the offset of the centers of the wafer and the platen, $\omega_w$ and $\omega_p$ are the angular velocity of the wafer and the platen, and $\theta$ the angle of the sensor with respect to the X coordinate. In addition to wafer rotation, in practice the wafer may translate relatively to the paten center, so called sweeping, with a velocity $\dot{r}_{cc}$ to utilize the entire pad surface. For simplicity, it is assumed that the sweeping is along the X coordinate. Therefore, the components of the relative velocity of the sensor to the wafer, $v_{X,R}$ and $v_{Y,R}$, in X, Y coordinates can be written as $$\begin{aligned} v_{X,R} &= v_{X,s} - v_{X,w} \\ &= [-r_s\omega_p \sin(\omega_p t + \theta_0) - \dot{r}_{cc}] + r_s\omega_w \sin\theta \\ &= -r_s(\omega_p - \omega_w)\sin(\omega_p t + \theta_0) - \dot{r}_{cc} \end{aligned} \tag{13a}$$

and $$\begin{aligned} v_{Y,R} &= v_{Y,s} - v_{Y,w} \\ &= r_s\omega_p \cos(\omega_p t + \theta_0) - \omega_w(r_s\cos\theta - r_{cc}) \\ &= r_s(\omega_p - \omega_w)\cos(\omega_p t + \theta_0) + \omega_w r_{cc} \end{aligned} \tag{13b}$$

These velocity components can also be represented in terms of a rotating coordinate system (x, y), with the original located at the center of the wafer and rotating at the same angular velocity $\omega_w$ as the wafer. The velocity components on the rotating coordinates, $v_{x,R}$ and $v_{y,R}$, are given by the coordinate transformation rule $$\begin{bmatrix} v_{x,R} \\ v_{y,R} \end{bmatrix} = \begin{bmatrix} \cos\omega_w t & \sin w_w t \\ -\sin\omega_w t & \cos w_w t \end{bmatrix} \begin{bmatrix} v_{X,R} \\ v_{Y,R} \end{bmatrix} \tag{14}$$

and can be written as $$v_{x,R} = -r_s(\omega_p - \omega_w)\sin((\omega_p - \omega_w)t + \theta_0) + r_{cc}\omega_w \sin\omega_w t - \dot{r}_{cc}\cos\omega_w t \tag{15a}$$

$$v_{y,R} = r_s(\omega_p - \omega_w)\cos((\omega_p + \omega_w)t + \theta_0) + r_{cc}\omega_w \cos\omega_w t + \dot{r}_{cc}\sin\omega_w t \tag{15b}$$

Therefore, the displacement of the sensor on the wafer with respect to the rotating x, y coordinates is given by integrating the velocity in Equations 15a and 15b.

$$\begin{aligned} x &= \int v_{x,R}\,dt \\ &= -r_s(\omega_p - \omega_w)\int \sin[(\omega_p - \omega_w)t + \theta_0]dt + \\ &\quad \omega_w \int r_{cc}\sin\omega_w t\,dt - \int \dot{r}_{cc}\cos\omega_w t\,dt \end{aligned} \tag{16a}$$

$$\begin{aligned} y &= \int v_{y,R}\,dt \\ &= r_s(\omega_p - \omega_w)\int \cos[(\omega_p - \omega_w)t + \theta_0]dt + \\ &\quad \omega_w \int r_{cc}\cos\omega_w t\,dt + \int \dot{r}_{cc}\sin\omega_w t\,dt \end{aligned} \tag{16b}$$

To solve Equations 16a and 16b for the position of the sensor on the wafer surface at a given time, a initial condition must be prescribed. It is convenient to assume that the sensor is initially located at the edge the wafer, with a initial angle $\theta_0$ with respect to the fixed X coordinate. For simplicity, it is also assumed that no sweeping motion occurs in polishing, i.e., $\dot{r}_{cc}=0$. In practice, the effect of sweeping motion on the sensor trajectory across the wafer can be neglected if the sweeping velocity is much lower than the liner velocities of the wafer relative to the pad. With those assumptions, the position of the sensor on the wafer can be expressed as $$x = r_s \cos[(\omega_p - \omega_w)t + \theta_0] - r_{cc}\cos\omega_w t \tag{17a}$$

$$y = r_s \sin[(\omega_p - \omega_w)t + \theta_0] + r_{cc}\sin\omega_w t \tag{17b}$$

As long as the condition $x^2+y^2<r_w$ (where $r_w$ is the radius of the wafer) is satisfied, the sensor is located inside the wafer/pad contact interface. Since the wafer is faced against the platen in polishing, the sensor trajectory given in Equations 16 and 17 is observed from the wafer back-side. The trajectory on the front surface is symmetric to the results from Equations 16 and 17 with respect to the y axis.

When the angular velocities of the wafer and the platen are equal, i.e. $\omega_w=\omega_p$, Equations 17a and 17b can be further simplified and the locus of the sensor is an arc with the radius equals to $r_{cc}$ and centered at ($r_s\cos\theta$, $r_s\sin\theta$,) relative to the rotating x, y coordinates.

$$(x - r_s\cos\theta_0)^2 + (y - r_s\sin\theta_0)^2 = r_{cc}^2. \tag{18}$$

Figure 17:
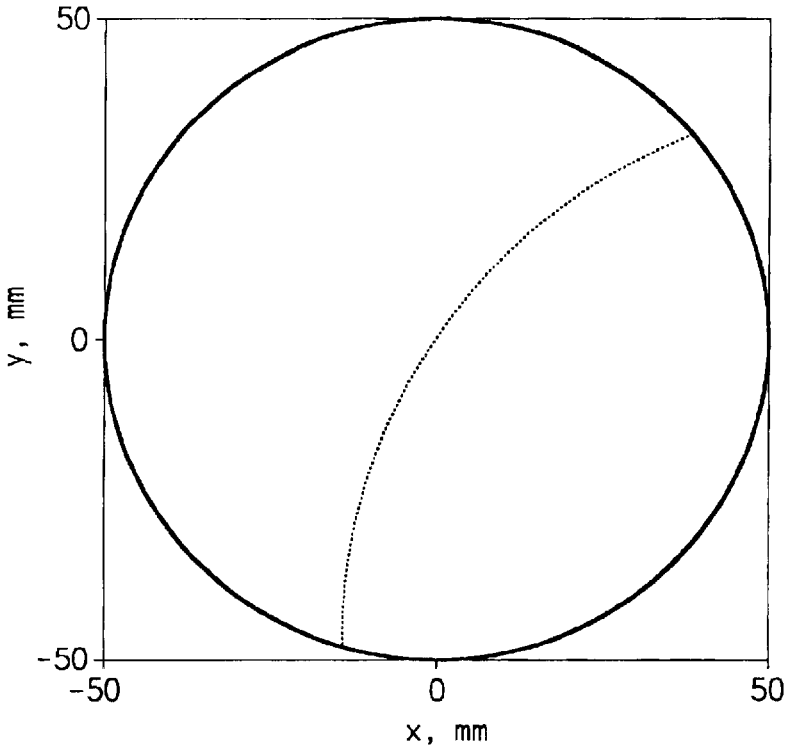
FIG. 17 shows the simulated locus for the reflectance sensor across the wafer at the condition $W_w-W_p$ and $r_s-r_{cc}$.
Figure 18:
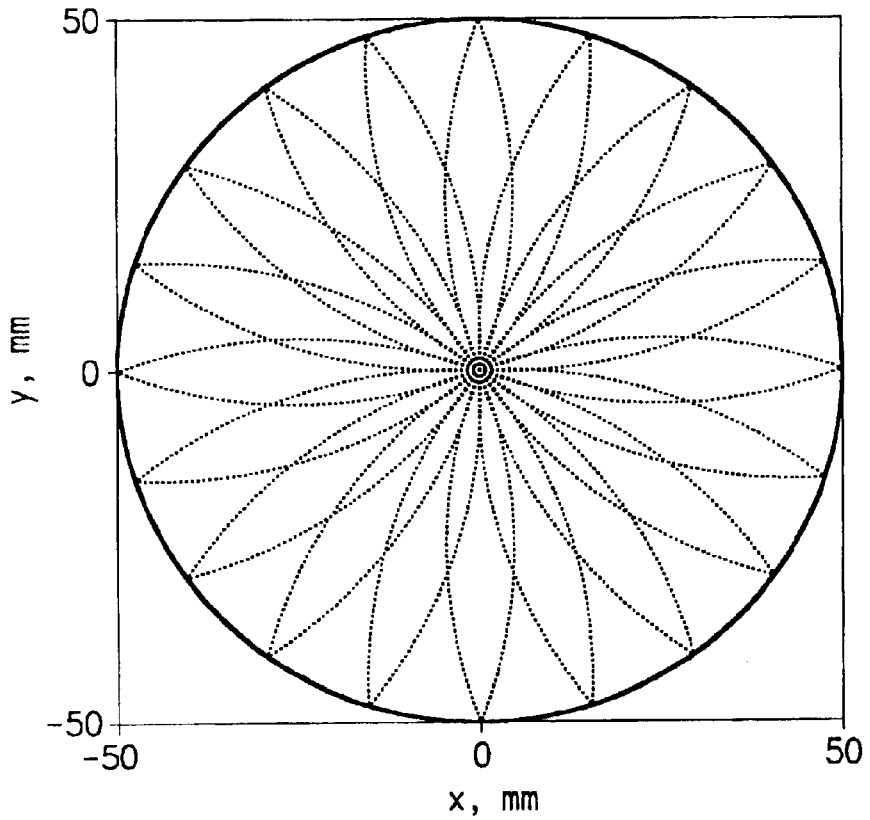
FIG. 18 shows the simulated locus for the reflectance sensor across the wafer at the condition $W_w-1.05W_p$ and $r_s-r_{cc}$.

When the angular velocities of the wafer and the platen are the same, the sensor enters the wafer/pad interface at the same point on the periphery of the wafer and always produces the same locus on the wafer surface, as shown in FIG. 17. In practice, the angular velocity of the wafer must be slightly offset from the platen so that the sensor can scan over the entire wafer surface in different radial directions. FIG. 18 shows the sensor loci for the conditions, $\omega_w=1.05\omega_p$ and $r_s=r_{cc}$, in which twenty identical loci start from twenty equally spaced points on the periphery of the wafer edge, respectively, and repeatedly if no wafer slippage occurs. As illustrated, the sampling density will be much higher at the center of the wafer, but lower at the edge where more dies are located. The lower sampling density on the edge dies might result in bias inference for the overall surface condition. How to design of sensor loci to sample enough data on desirable surface area will be discussed later in detail.

The surface conditions of the wafer during polishing can be extracted from the real-time reflectance data. The statistics employed to infer the surface conditions include the maximum and minimum reflectance values, the range, the mean value, the variation, the shape of the distribution of the reflectance data, etc. Three levels, including wafer-, die- and device- or subdie-level, of information can be obtained from the dataset. The spot size of the sensor is so chosen that it is comparable or smaller than the subdie area but still much larger than dimensions of interconnects. Therefore, an individual measurement represents the reflectance on the specific device or pattern area on the wafer, from which the surface topography and Cu area fraction can be inferred. In reality, however, it is difficult to map the measurement results onto the exact location of a particular device or pattern because of wafer slippage inside the carrier. The individual datum only can be mapped onto the surface within a grossly defined area. Similarly, the die-level information may be obtained based on the samples along a specific segment(s) corresponding to the die location on the loci. However, it may only roughly represent the surface condition within the vicinity of the interested die region. Fortunately, the polishing results for the dies at the same radius to the wafer center very often exhibit the similar trend. Hence, data from within adjacent dies at the same radius sometimes may be combined to increase the sample size for the die at a particular radius to elucidate the spatial dependence of material removal in the radial direction.

Moreover, the wafer-level information can be retrieved either from a single scan or multiple scans across the wafers. In the practice of endpoint detection, it is preferable to take enough samples from multiple loci so that the surface condition over a specific region or even on the entire wafer surface can be determined from this combined (or "pooled") dataset. The more loci are employed, the more uniformly the samples and the larger size of samples can be taken on the surface. Therefore, a higher level of inference can be achieved. The only concern is that the surface condition may change significantly during a long sampling period of multiple scans. This may affect the reliability of the inference and will delay decision making and feedback control. In order to eliminate this drawback, the moving average method is employed to estimate the average reflectance on the surface. The sensor scans across the wafer surface once per platen revolution. Suppose the reflectance sampled at the j-th point along the locus at the i-th time period, each time period is equal to the duration for one revolution of platen, is denoted as $x_{ij}$. If total n points are taken along each locus, the mean reflectance along the locus at the i-th period, $\overline{X}_i$, is given as $$\overline{x}_i = \frac{1}{n}\sum_{j=1}^{n} x_{ij} \tag{19}$$

Suppose the number of loci to cover the entire wafer surface or a area of interest is w, the moving average of the sampling reflectance at the i-th period, $M_i$, is defined as $$M_i = \frac{\overline{x}_i + \overline{x}_{i-1} + \ldots + \overline{x}_{i-w+1}}{w} \tag{20}$$

That is, at the i-th time period, the observations from the newest one scan and the previous (w−1) scans are employed to estimate the mean reflectance of the entire wafer or the surface of interest. Thus, the surface condition inferred from the reflectance measurements can be updated every scan. For example, it is about 10 scans to have the sensor cover the wafer at the condition of $\omega_w=1.05\omega_p$, If the platen runs at 75 rpm, it takes 8 seconds to scan over the entire surface, in which the locus rotates 180° relative to the wafer, and 16 second to rotate back to the first locus. The moving average can capture the change of surface reflectance due to both the change of surface topography and the change of Cu area fraction within a short period, in this case less one second. However, it may still smooth over the rapid change due to the partial oxide exposure on small portion of the wafer surface near the onset of endpoint by averaging the current data with the previous data (which is taken across 8 seconds in the example).

On the other hand, the (total) variance of the surface reflectance at i-th time period $S_i^2$, can be estimated based on the same pooled dataset employed in the moving average.

$$S_i^2 = \frac{\sum_{i-w+1}^{i}\sum_{j=1}^{n}(x_{ij} - M_i)^2}{N-1} \tag{21}$$

where N is the total number of samples in the moving average subset (N=wn). The total variance is calculated based on the deviation of the reflectance at each sampling point relative to the total estimated mean of the entire wafer or the surface of interest, which is estimated by the moving average. In addition to the (total) variance, the variance along each locus, the range of data, and their maximum and minimum must be tracked to assist identify the rapid change of surface reflectance at the moment when barrier or oxide layer exposes. It can be employed to determine the percent overpolished area on the wafer surface at the end of the process. Additionally, the distribution of the data can be used to determine the regime of polishing. For example, the skewness of the data distribution in polishing can be compared with the theoretical value at end-point, which can be estimated based on the given pattern layout and sensor kinematics. The definition of skewness β can be found in many statistics texts, and may be defined as (Sachs, 1982)

$$\beta = \frac{3(\overline{x} - \tilde{x})}{S} \tag{22}$$

where $\overline{X}$ is the mean, $\tilde{X}$ the median and S the sample standard deviation of the selected dataset, which can be estimated from one locus or multiple loci, which can be calculated from Equations 19, 20, and 21. These statistics can also be applied to the die-level estimation of surface condition. For instance, data taken within a specific range of radius (a ring region) can be combined, the same statistical methods can be employed to estimated the surface reflectance over the specific area. The effectiveness of each of these methods on endpoint detection will be examined in the discussion section.

The following experiments are provided for illustration purposes only, and are not intended to limit the scope of the invention in any way. An optical sensor unit (Philtec D64) composed of light-emitting diodes (LEDs), bundled glass fibers for light transmission and receiving, and an amplifier was employed for detecting the conditions of the wafer surface based on the surface reflectance. The specifications of the sensor are listed in Table 1.

TABLE 1

Specifications of the reflectance sensor.

| Item | Specification |
|---|---|
| Light Source | High Intensity LED |
| Wavelength (nm) | 780–990 ($\mu$ = 880, $\sigma$ = 50) |
| Spot Diameter (mm) | 1.6 |
| Light Beam Spread (°) | 30 |
| Operation Distance (mm) | 0–6.35 |
| Stability (%) | <0.1% full scale |
| Frequency Response (kHz) | <20 |

Figure 19:
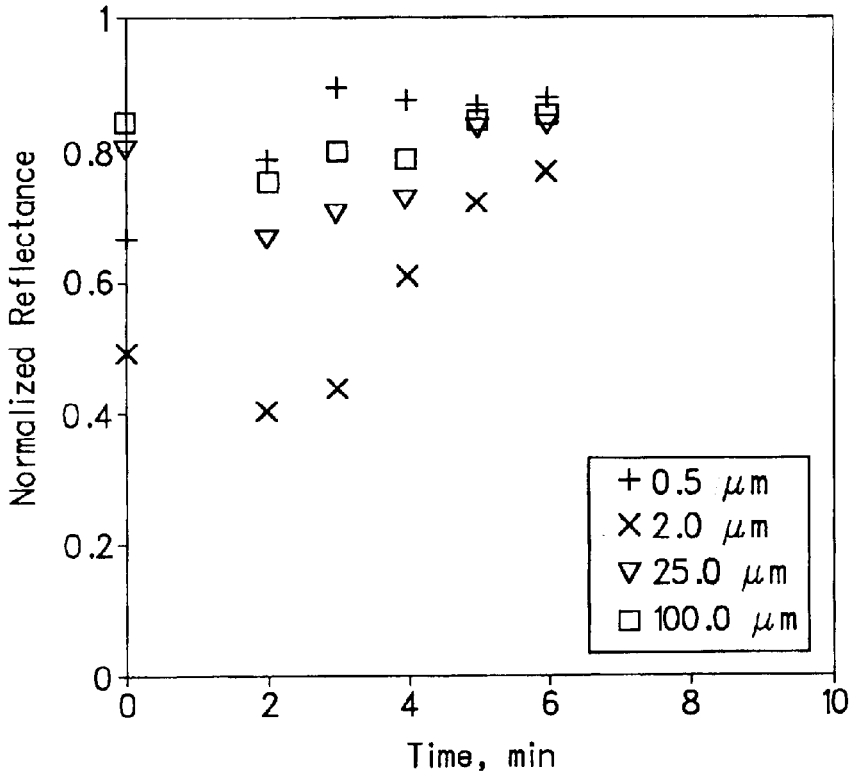
FIG. 19 shows the results of off-line measurements at the copper planarization regimes on the pattern with 0.5 area fraction ($w/\lambda=0.5$) in accordance with one embodiment of the present invention.
Figure 20:
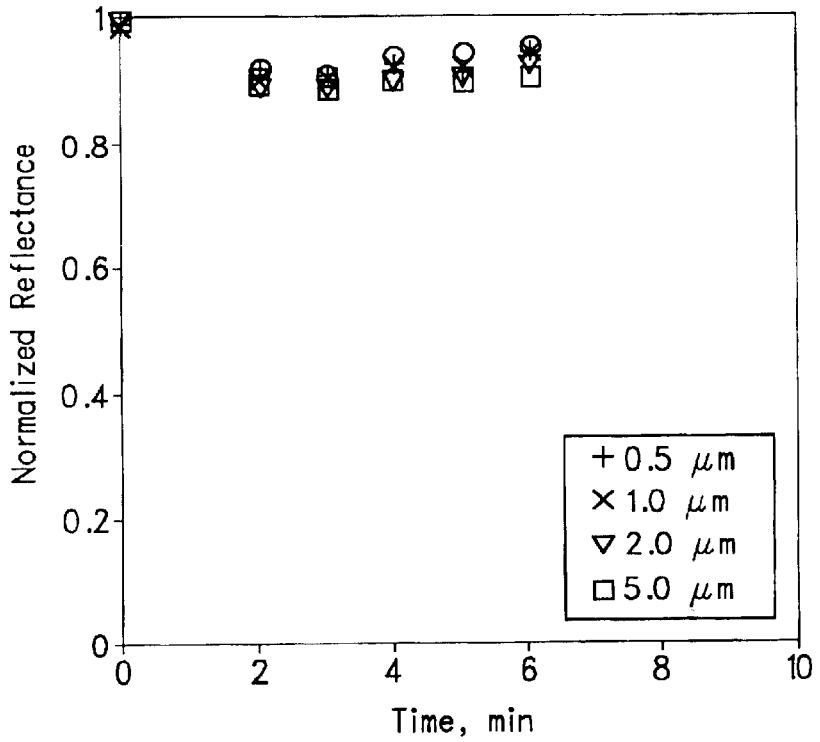
FIG. 20 shows the results of off-line measurements at the Cu planarization regime on the patterns with 0.01 area fraction ($w/\lambda=0.01$) in accordance with another embodiment of the present invention.

As shown in FIG. 19, the spectrum of the LED light source ranges from 775 nm to 990 nm, with a mean around 880 nm and standard deviation about 60 nm. At the sensor tip, the uncollimated light rays diverge outward from the transmit fibers, and only the reflected light within the area with the same diameter, about 1.6 mm, of fiber bundle is received. The particular spot size was chosen so that it is small enough to detect different surface conditions on different patterns (sub-die areas) on the wafer. However, it is larger than the individual line or feature to even out the small variation of reflectance due to local (sub-device level) randomness of material removal. Because of the divergence of the light beam, the sensor is sensitive to the gap between the tip and the targeted surface. FIG. 20 shows the characteristic of the sensor output (reflectance) on a mirror surface corresponding to the gap distance. In practice, the sensor was operated at a distance of around 5 mm so that the sensor response is less sensitive to the slight change of gap distance during polishing or the surface waviness of the wafer.

The sensor unit was installed on the platen base with the tip embedded inside a holder through the platen. On the polyurethane polishing pad stacked on the platen, a translucent window made of plastic (Rodel JR111) was employed to enable the sensor view the wafer surface. The material of the window has similar wear properties as those of the pad so that the surface of the window remained at the same level of the rest of the pad surface and did not affect the sensor measurement or polishing uniformity. The sensor was linked to a power supply and a data acquisition system via the rotary coupling. The output signal was amplified before the coupling to enhance the signal to noise ratio. Additionally, an off-line set-up was employed to measure the surface reflectance of the polished wafer. Two rotary stages with angle readings were utilized to mimic the kinematics due to the rotation motion of the wafer carrier and the platen. The position of the sensor on the wafer were determined based on the angles of both the rotation of wafer and sensor arm and the distance between two centers of rotary stages. By comparing the measurements from the this set-up to those from in-situ sensing, the effect of slurry and wafer slippage on the reflectance sensing may be identified.

Both blanket and patterned Cu wafers were employed for experiments to verify the capability of the sensor and to determine the detection schemes. The blanket Cu wafer was composed of a 20 nm TaN barrier layer and then followed by a 1 $\mu$m thick PVD Cu coating on a Si substrate. For the patterned wafer, a tested damascene structure was employed, which was composed of an array of line-spacing structures with different linewidths and pitches. A detailed floor layout of the pattern can be found in a previous chapter. This pattern is transferred into a 1.5 $\mu$m thick TEOS coating with trenches etched to a depth of 1 $\mu$m on a 100 mm silicon substrate. A 20 nm Ta layer followed by a 1 $\mu$m thick PVD Cu layer was deposited on the top of the patterned oxide surface. The experimental conditions are listed in Table 2.

TABLE 2

Experimental conditions.

| Experimental Parameters | Experimental Conditions |
|---|---|
| Diameter of Wafer (mm) | 100 |
| Normal Load (N) | 391 |
| Normal Pressure (kPa) | 48 |
| Rotational Speed (rpm) | 75 |
| Linear Velocity (m/s) | 0.70 |
| Duration (min) | 1–6 |
| Sliding Distance (m) | 42–252 |
| Slurry Flow Rate (ml/min) | 150 |
| Abrasive | $\alpha$-$Al_2O_3$ |
| Abrasive Size (nm) | 300 |
| pH | 7 |

In this section, experimental results of blanket and patterned Cu wafers are examined to study the characteristics of the reflectance sensing technique. The reflectance of a planar Cu area measured in polishing may deviate from the theoretical value due to surface roughness, slurry particles, variation of gap between the wafer and the sensor in polishing, and random noise from various sources. Variation of surface reflectance due to these effects is studied based on the measurement on blanket wafer polishing. Additionally, the surface reflection in patterned wafer polishing is affected the surface topography in the planarization regime and by the area fraction in the polishing regime, which significantly contributes to the variation of measurements. Both off-line and in-situ measurements were conducted to study the effects of pattern geometry and Cu area fraction on the reflectance. These results are compared with the reflectance from light scattering theory with the assumptions of single wavelength, plane incident wave and periodic surface structure. The characteristics of reflectance across the wafer or a desired area during polishing are examined to correlate the measurements with different regimes of Cu CMP. These will help establish different schemes for in-situ sensing and endpoint detection.

Tests on the Blanket Wafers.

A typical result of surface reflectance on a blanket Cu wafer during polishing is shown in the figures. To elucidate the effects of slurry and scratching, the normalized mean reflectance is defined as the average reflectance over ten passes across the wafer divided by the reflectance on a scratch-free Cu wafer under the same pressure condition (at the same gap between the wafer surface and the sensor). At the initial stage, the reflectance was about 30% less than that without slurry. The reduction was due to the light scattering from slurry particles and the increase of gap distance resulting from the presence of slurry layer. Since the sensor was operated in the range in which it is less sensitive to the change of gap distance, the decrease of reflectance was mainly due to the particle scattering. The normalized mean reflectance gradually dropped 0.1 to about 0.6 after 30 seconds of polishing and the standard deviation increased to about 0.15 from the initial small value. These indicate that the surface was roughened due to particle abrasion. Thereafter the mean reflectance and the standard deviation remained at constant levels for about 3 minutes. After 4 minutes, the variation of the surface reflectance increased without change of the mean. Inspection of wafer surface at this stage indicated that a small portion of the Cu was cleared and the less reflective TaN was exposed on the surface. Since the majority of the surface was still covered with Cu, the mean did not drop significantly. Then, the mean started to drop and the variation kept increasing with the increase of the Cu clearing. Until the majority of Cu was cleared, about 6 minutes, the standard deviation kept decreasing and the mean gradually reached a lower level. The harder TaN barrier acted like a polishing stop and retained a low level of variation of surface reflectance after all the Cu is removed. After overpolishing for two more minutes, the TaN was polished through and the mean reflectance decreased further.

Off-Line Measurements on Patterned Wafers.

The effects of surface topography on reflectance are shown in FIGS. 19 and 20.

Figure 21:
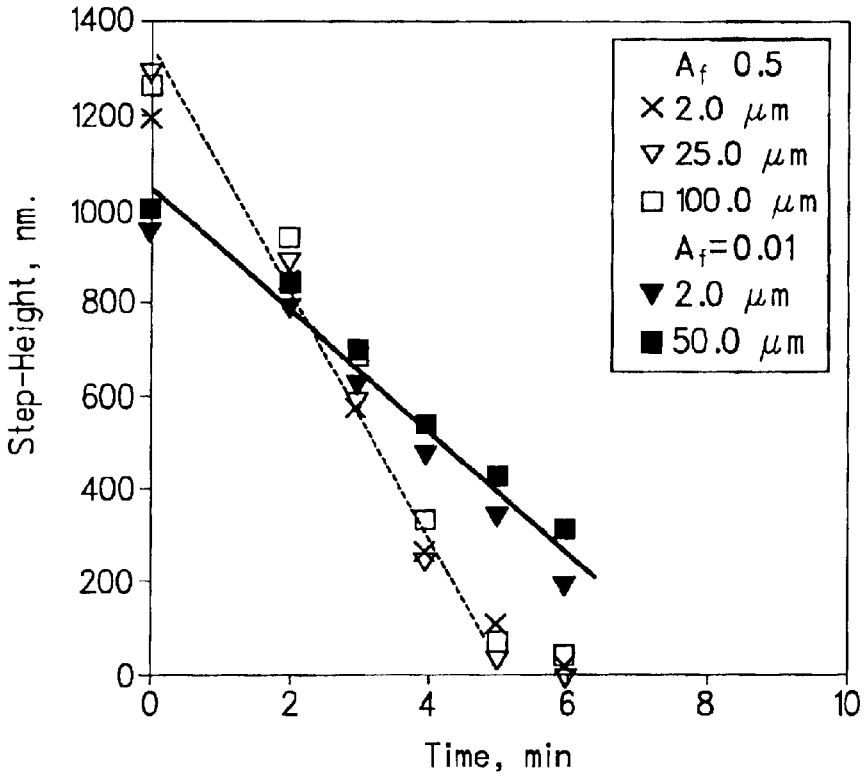
FIG. 21 shows the time evolution of step-heights for patterns with constant area fraction 0.5 and 0.01 in accordance with experiments of the present invention.

These data were observed off-line on patterns at the center die with various linewidths and constant area fractions of 0.5 and 0.01, respectively. The normalized reflectance is defined as normalizing the measured reflectance on each sub-die by the reflectance on the unpolished blanket Cu surface. The corresponding step-height evolution for these damascene structures (sub-dies) is shown in FIG. 21. To extend the planarization regime, lower nominal pressure (28 kPa) and relative velocity (0.46 m/s) were applied than those of the industrial practice. By six minutes, most of the high features were removed and the surface had planarized before the Cu was polished through. For the patterns of 0.5 area fraction, the initial variation of the reflectance resulted from the variation of step-height and pitch on the surfaces of different sub-die. Since the initial step-heights are close for the patterns with linewidth 2, 25 and 100 $\mu$m, except that of the 0.5 $\mu$m structures, the reflectance is mainly affected by the pitch (or linewidth) of the pattern. The smaller the pitch, the more light scattering occurs on the surface and reduces the reflectance. This can be explained by the less reflective Cu surfaces on low features due to the coarse microstructure from the deposition process. After being polishing for two minutes, the normalized reflectance decreased, about 0.1, instead of increasing gradually with the reduction of step-height. This is because the surface roughness increased by particle abrasion and contributed to the overall reduction of the surface reflectance. The reflectance of the 0.5 $\mu$m line area, however, increased because the surface was mostly planarized before two minutes.

Figure 22:
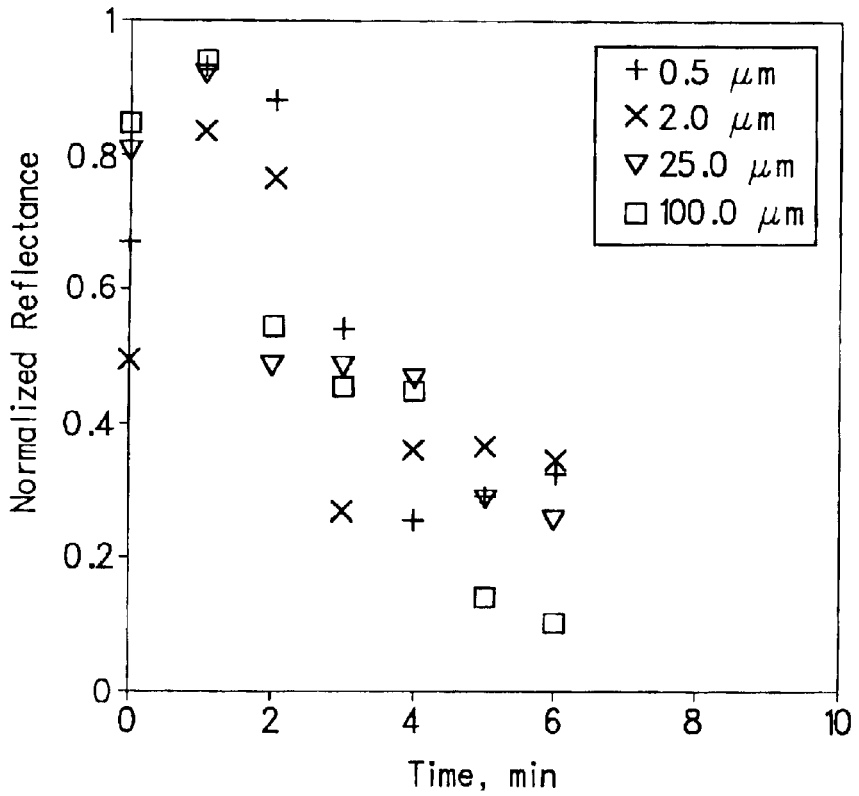
FIG. 22 shows the results of off-line measurements at various process regimes on the pattern with 0.5 area fraction.
Figure 24:
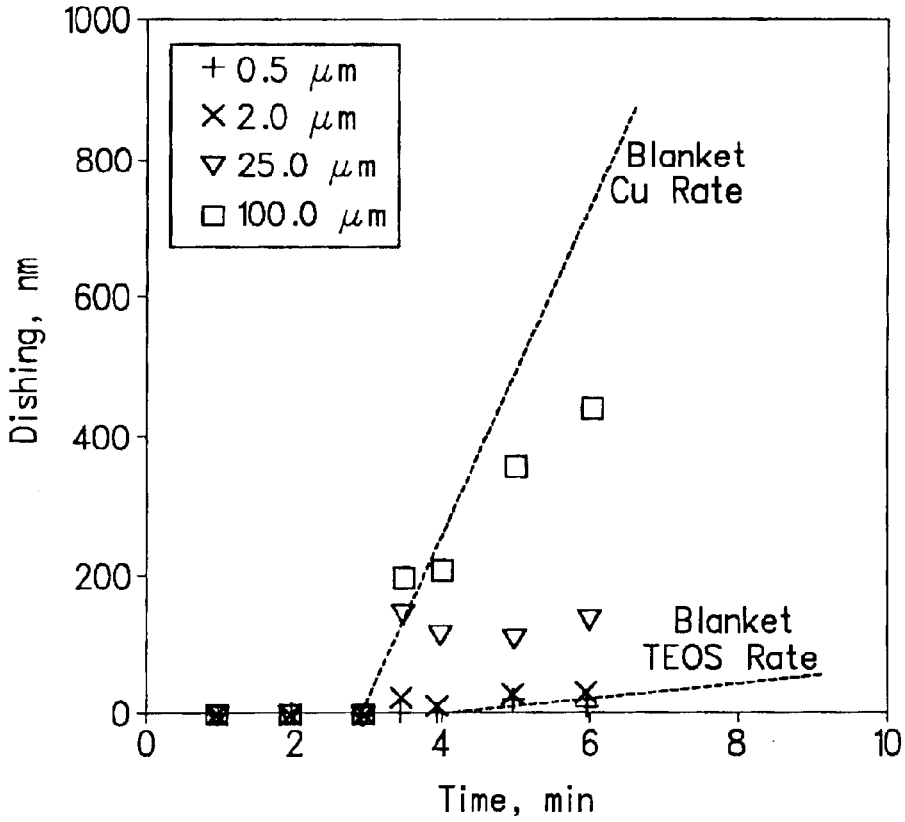
FIG. 24 shows the time evolution of Cu dishing for patterns with constant area fraction 0.5 and various linewidths.

The reflectance increased gradually for each pattern after the initial drop and then finally reached a steady value due to the planarization of high features. This trend has been explained in the theory section that the light is more likely to scatter into the direction of specular reflection and received by the adjacent receive fibers when the step-height decreases. As shown in FIGS. 22 and 24, the step-heights for various features were less than 100 nm after polishing for 5 minutes, and the normalized surface reflectance for various features reached a similar steady level, about 0.85, on the tested wafers. This implies that the employed optical sensing technique is less sensitive to the small variation of the surface topography. The reflectance for the patterns of 0.01 area fraction also dropped to about 0.1 due to the increase of surface roughness and then remained at the same level of 0.9 till the surface was planarized. Since the area fraction is small, the surface reflectance is not significantly affected by the evolution of the pattern topography, and the measurements are similar to those on a blanket Cu surface.

Figure 23:
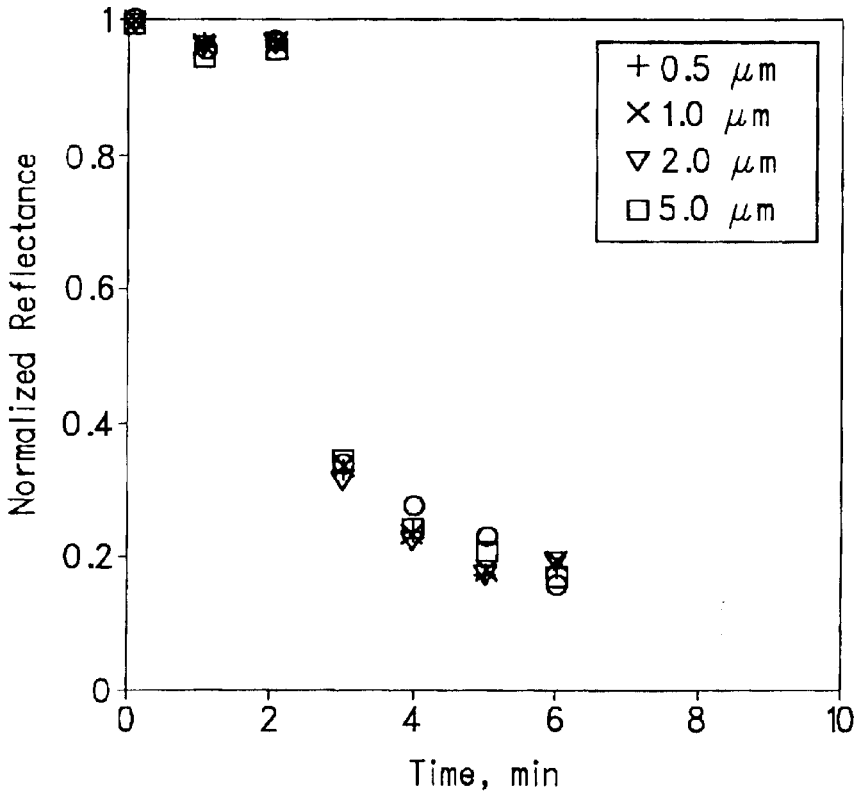
FIG. 23 shows the results of off-line measurements at various process regimes on the patterns with 0.01 area fraction.
Figure 25:
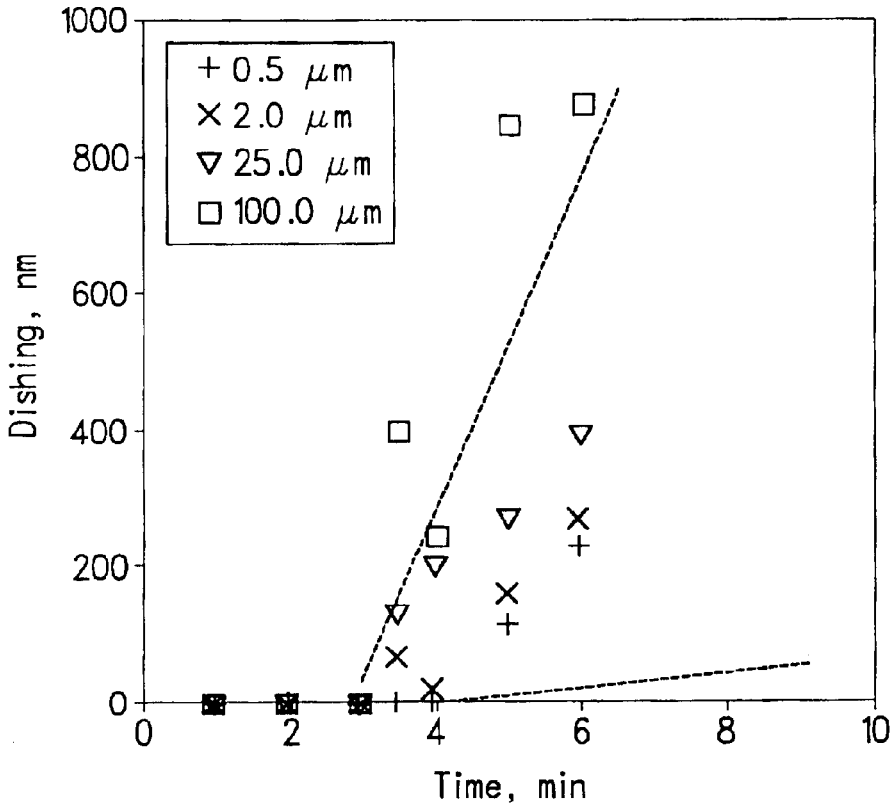
FIG. 25 shows the time evolution of Cu dishing for patterns with constant area fraction 0.01 and various linewidths.

FIGS. 22 and 23 show the trend of surface reflectance of various patterns, with 0.5 and 0.01 area fractions, in the different process regimes—planarization, polishing and overpolishing. The corresponding evolution of dishing is shown in FIGS. 24 and 25, respectively. The pressure and the velocity applied was close to the industrial practice of 48 kPa and 0.79 m/s. The surface topography was planarized on most of the patterns after 1 minute of polishing and the normalized reflectance reached a similar level about 0.9 for all patterns tested. Between 1 and 3 minutes, the planar Cu layer was removed like that in blanket Cu polishing and the normalized reflectance stayed the same constant about 0.9 and was independent of original pattern geometry. After about 3 minutes, the reflectance dropped significantly and sharply because the Cu layer had been polished through and the less reflective underlying oxide appeared partially on the surface. Since the planarization rate is dependent on the pattern geometry, the sub-die areas with higher area fraction may have been polished through faster. In FIGS. 22 and 23, the sub-die with high area fraction of 0.5 was polished through first and the Ta barrier was exposed after about 2 minutes. Concurrently, the reflectance started to drop to about 0.8 when the Ta started to expose and then further down to about 0.5 when the oxide surface was exposed at 3 minutes. Nevertheless, all tested patterns seemed to reach the onset of oxide exposure, between 2 and 3 minutes.

After the onset of oxide exposure, the reflectance kept decreasing until all the excess Cu and barrier (Ta) materials were removed (i.e., process endpoint), after about four minutes of polishing. After the endpoint, the reflectance seemed to remain constant, regardless of the slight increase of topography due to dishing of the soft Cu lines and rounding and overpolishing on the adjacent oxide regions. This again agrees with the earlier results in that the employed sensing technique is not sensitive to the small variation of the step-height. Hence, the variation of the reflectance in this regime was mainly due to the different area fraction of Cu interconnects. The areas with higher area fraction generally are more reflective. However, the experimental values were lower than those of theoretical prediction of reflectance for all patterns, especially for those with high area fractions. The theory predicts that the (normalized) reflectance is about 0.62 and 0.24 for the patterns with area fractions of 0.5 and 0.01, respectively, in which the $R_{TEOS}/R_{Cu}$ ratio of 0.23 is assumed based on the experimental measurement on blanket films. In reality, the light transmitted through the oxide and reflected from the underlying Si substrate may be blocked by the Cu lines, which decreases the intensity of reflected light from the oxide surface and reduces overall reflectance of the sub-die. Additionally, scratches and less reflective Cu oxides (due to corrosion) were found on the surfaces of Cu lines, which also resulted in a reduction of surface reflectance, especially for the pattern with more Cu area fraction.

Off-Line Measurements along the Sensor Loci.

Figure 26:
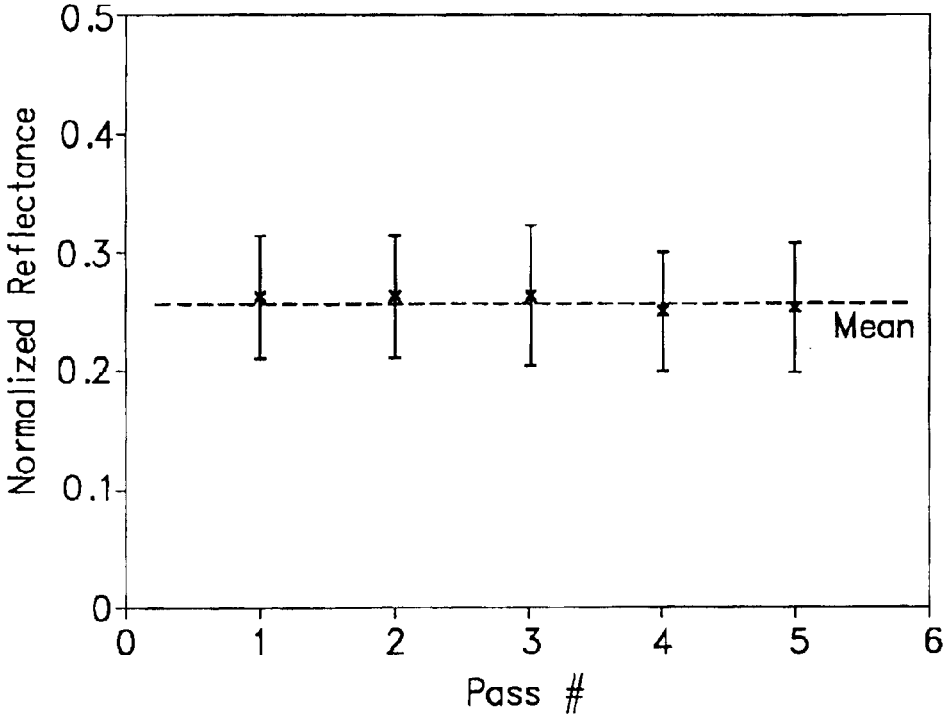
FIG. 26 shows the off-line measurements of the mean and standard deviation of surface reflectance along different loci across the wafer at the onset of endpoint.

The off-line measurements along different sensor loci in terms of the mean value and the standard deviation are plotted in FIG. 26. The wafer employed is the one shown in a prior section and polished for 4 minutes at normal conditions, in which the majority of dies have been polished to the end-point and some may have been overpolished slightly. The loci employed follow the sensor trajectories in polishing at the conditions of $\omega_w=\omega_p$ and $r_s=r_{cc}$, in which the sensor travels along the arc of a radius $r_{cc}$. Loci across different radial directions were employed to elucidate the effects of different loci on the statistics of the surface reflectance of the patterned wafer. It was found that the mean and the variation of reflectance data across wafer varied with the orientation of the locus. The mean value varied from 0.24 to 0.26 among the selected loci, compared to of the average reflectance about 0.25 of the center die. The standard deviation varied between 1 and 1.2, compared to 1.8 in the center die. The variations of the mean and standard variation mainly resulted from the different sensor loci due to the non-axial-symmetric pattern layout and from the within-wafer nonuniform polishing. It is not uncommon that the within-wafer nonuniform polishing often exhibits an axial symmetric fashion, such as "bull's eye effect" (Stine, 1997). Therefore, the variations of reflectance between loci due to wafer-level nonuniformity may be comparable to that contributed from the pattern layout.

Figure 27:
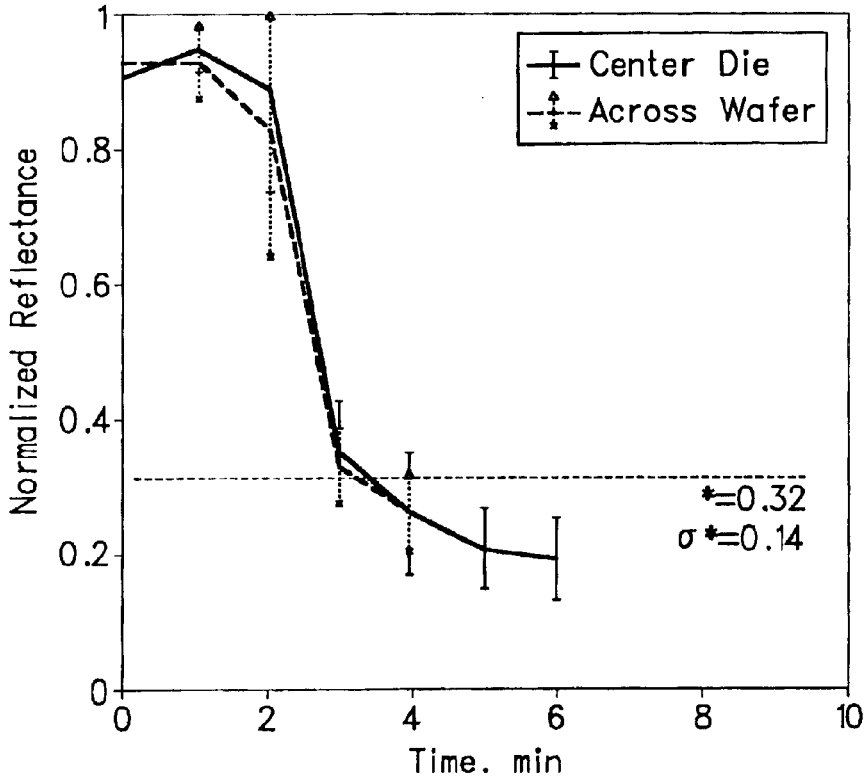
FIG. 27 shows a comparison of the off-line measurements (mean and standard deviation) on the center die and across wafer at various polishing stages. The across-wafer data is calculated based on the measurements along five loci.

FIG. 27 shows the mean and standard deviation of the surface reflectance on the center die and across wafer on the off-line measurement set-up at different polishing stages. The effect of different loci is minimized by combining data from several loci, for instance from 5 different loci evenly across the wafer in this case. The effect of within-wafer nonuniform polishing on the variation of surface reflectance can be determined by comparing the difference between those two data sets. Before polishing, the mean reflectance across the wafer is higher than that on the center die because of the nonuniform coating from the Cu PVD process. The step-heights of patterns are found smaller at the edge dies and thus the average reflectance on edge dies will be higher than that of center dies. Hence the overall mean reflectance is smaller than that of the center die. Similarly, the standard deviation of the edge dies is generally smaller because trenches is more shallow due to the nonuniform Cu deposition. After polishing for a short duration, the overall mean became less than the average reflectance of the center die. This is because the polished rate at the edge was faster than at the center, and the less reflective barrier and/or oxide layers were expose at the wafer edge. The standard deviation of the reflectance across the wafer was also greater than that of the center with the increase of surface nonuniformity. More barrier and oxide layers were exposed and progressed from the edge toward the center with the increase of time. With the increase of the wafer-level nonuniformity, the difference between the two means and the standard deviations increased continuously. Until the majority of the dies reach the end-point, the mean surface reflectances across the wafer and at the center return to similar levels because the hard oxide layers retains the surface uniformity even with a slight overpolishing and the small dishing will not affect the reflectance significantly. The variation of the reflectance of the center die of the 4-minute sample is greater due to the remaining small patches of Cu/barrier materials. In practice, the overall mean and variation of the reflectance may be compared with those on different surface areas (die-level zones) to determine the process endpoint.

In-Situ Measurement on Patterned Wafers.

Figure 28:
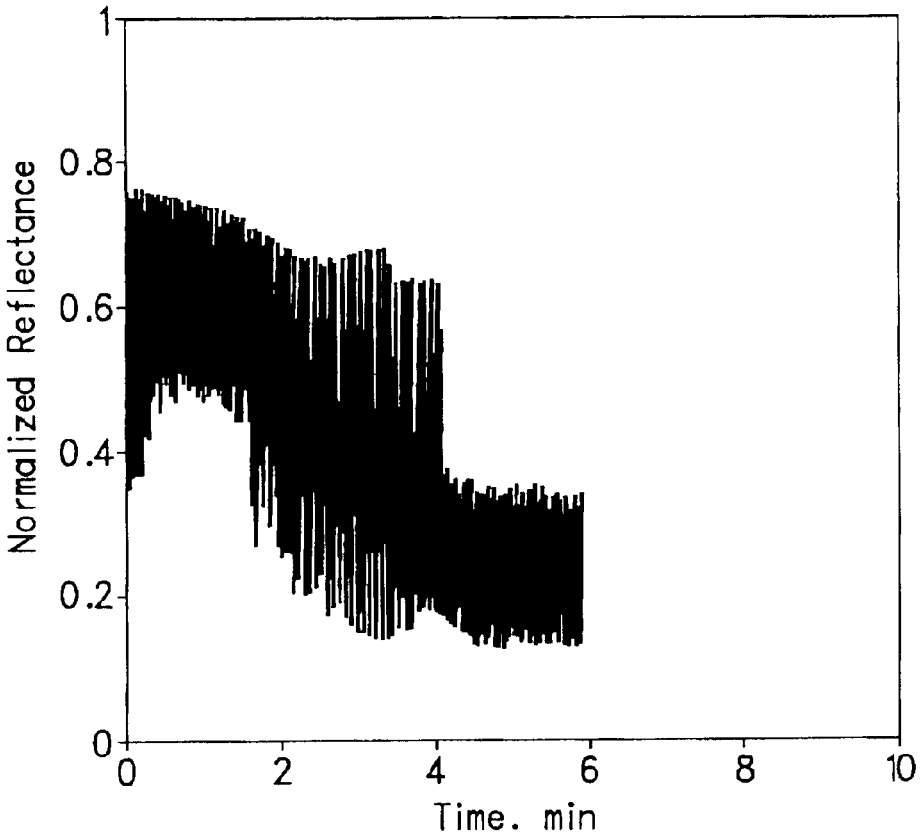
FIG. 28 shows raw data from in-situ reflectance measurements made according to examples of the present invention.
Figure 29:
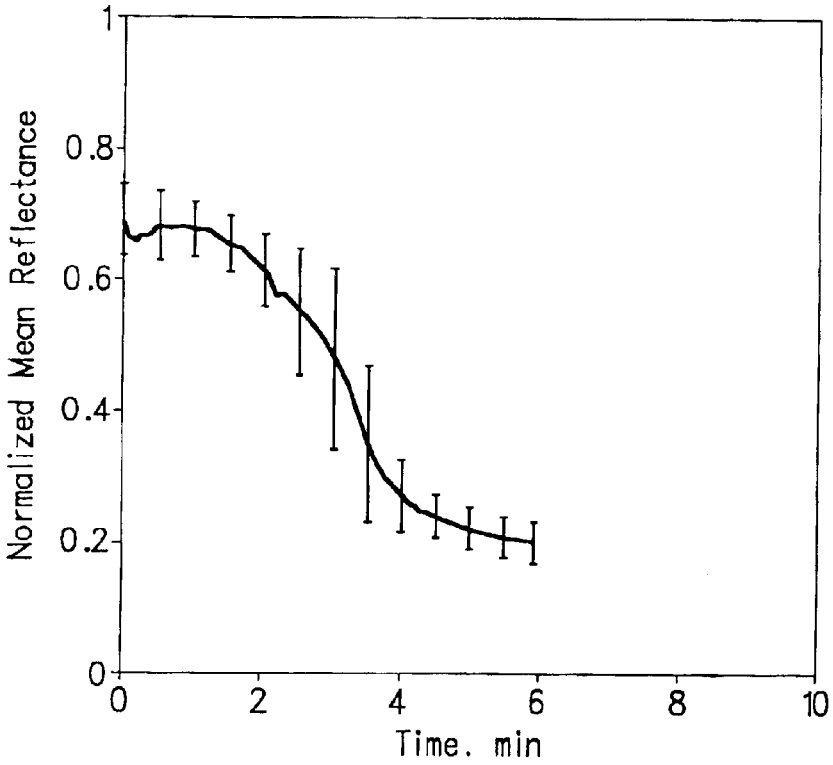
FIG. 29 shows the results of in-situ measurements of the moving average and standard deviation of wafer-level surface reflectance.

An example of in-situ measurement on patterned Cu wafer is shown in FIG. 28. The y-axis represents the raw data of normalized surface reflectance, which is defined as the reflectance measured divided by the reflectance on blanket Cu wafers before polishing. In the experiments, the angular velocity of the wafer was offset from the angular velocity of platen by 5 percent ($\omega_w$=1.05$\omega_p$) so that the loci covered the wafer surface. The moving average of the reflectance for ten passes and the standard deviation based on the pooled data from those passes are shown in FIG. 29. Compared with that from the off-line apparatus, the reflectance measured in polishing was lower because of light scattering by the slurry. It dropped approximately 20% to 25% in the planarization regime, but less significantly in the overpolishing regime. The mean decreased slightly right after polishing because of surface roughening. Then it started to increase until reaching a constant level around 1 minute after the surface had been planarized, as discussed in the earlier paragraphs. After 2 minutes, the mean dropped again because of the exposure of Cu on the surface. Since the Cu was removed nonuniformly due to the initial pattern layout and the variation of the coating thickness, the underlying oxide was gradually exposed on the surface and the mean dropped less steeply compared with data on a specific die, such as the center die in the earlier example. The onset of wafer-level endpoint was about 4 minutes in this experiment and the mean kept increasing, but at a slower rate, after the endpoint with the gradual increase of surface roughness due to overpolishing and dishing. Since the effect of slurry and the lack of clear sign for endpoint indication, the mean can only serve as a rough indication of the onset of process endpoint.

Figure 30:
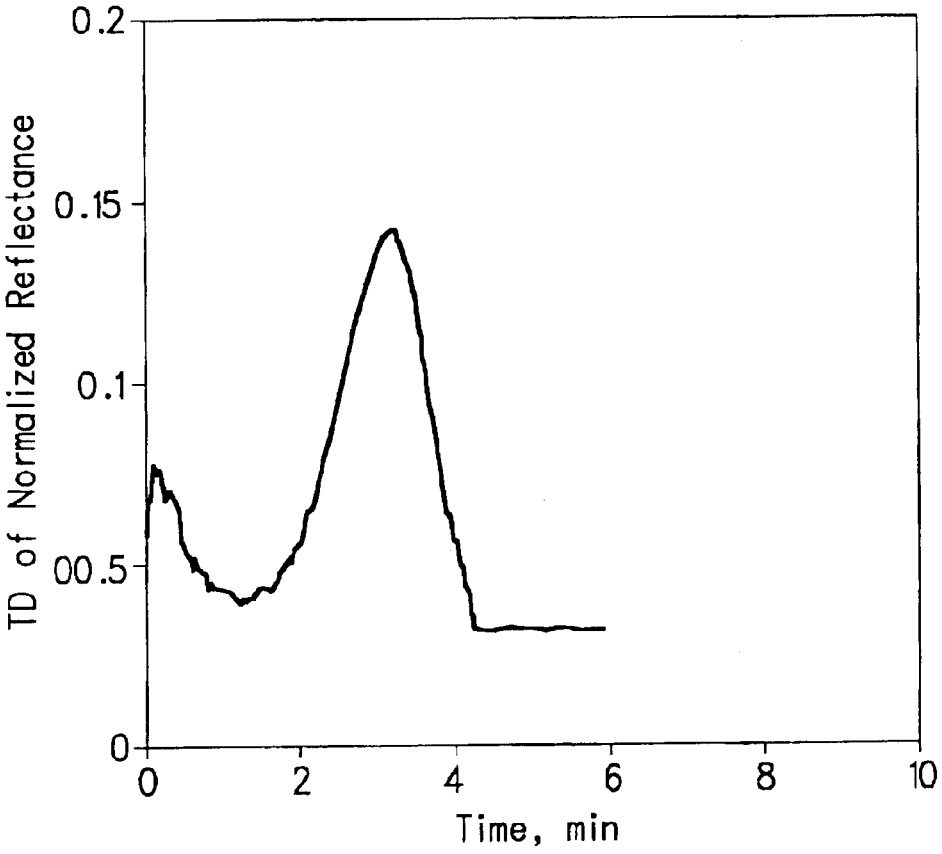
FIG. 30 shows the results of in-situ measurements of the standard deviation of wafer-level surface reflectance.
Figures 31A, 31B, 31C, 31D, 31E, 31F:
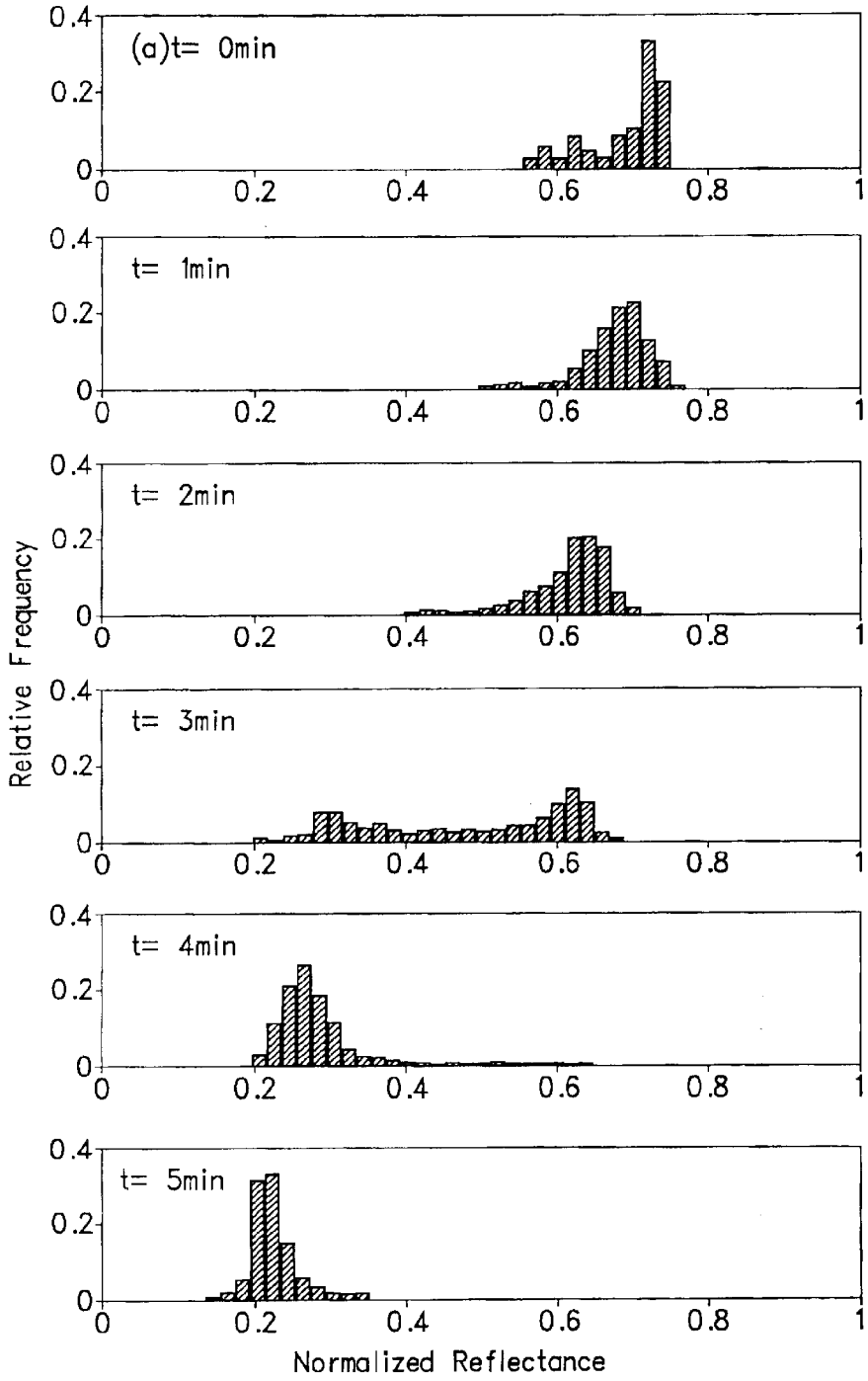
FIGS. 31*a* to 31*f* shows the distribution of surface reflectance versus polishing time from the in-situ measurements made according to examples of the present invention.

The standard deviation of the pooled data in the moving sampling set over ten passes is plotted versus time in FIG. 30. Since the variation of the reflectance is mostly due to the pattern geometry and Cu area fraction, the distribution is generally not normal. The distribution of the normalized reflectance in terms of relative frequency is shown in FIGS. 31*a* to 31*e*, in which the distribution of reflectance from the off-line measurement is also shown in dash-line for comparison. There are two peaks of the standard deviation. The first peak occurs at the beginning of the process corresponding to the minimum mean reflectance in the Cu planarization regime, which resulted from the initial surface topography and surface roughening. The initial shape of the distribution remained similar to that measured off-line, which represents the initial surface topography of the wafer. The standard deviation in the planarization regime reached a minimum when the majority of the pattern has been smooth down and the mean reached a maximum. The surface condition at this stage is similar to that of a blanket wafer. The variation of the surface reflectance is affected by the surface roughness, slurry scattering and random error of measurement and thus represents a normal fashion in FIGS. 31*b* and 31*c*. The maximum variation of the reflectance occurs in the middle of Cu clearing regime, at about 3 minutes of polishing in this case. A broad distribution with two peaks is observed in FIG. 31*d*. The subgroup of surface reflectance centered at a lower value represents the subdie area on which the oxide is exposed. The other subgroup with the mean close to the rough blanket surface indicates that the high reflective Cu and/or Ta barrier layers still partially cover the surface. After the maximum, the standard deviation decrease quickly with the increase of area of oxide exposure. At the onset of endpoint, he standard deviation reach a sharp turning point and then remain at a low constant level. As observed in the previous off-line measurement, the variation of the surface reflectance reach a minimum when the high reflective Cu is cleared. However, since the resolution of the sensor is limited by the spot size, it may not be possible to effectively detect the small patches of metals on the surface. In practice, a short period of overpolishing may be applied to ensure that all the Cu/barrier materials are removed. After the endpoint, the standard deviation is determined by the designed pattern layout (local Cu area fraction) which affects the skewness of the distribution. Therefore, the variation of surface reflectance will not change significantly with the small variation of surface topography resulting from overpolishing and dishing.

Locus Design and Sampling Plan.

The sampling scheme relies greatly on the design of sensor loci and sampling frequency to achieve an effective plan and provide reliable information of the underlying distribution of surface reflectance. At the die-level, many loci must be taken on the die of interest to detect the variation of reflectance due to the nonuniform topography, Cu area fraction and the non-symmetric layout. Based on the kinematics, the sensor locus is determined by the parameters of $\omega_w$, $\omega_p$, $r_s$, and $r_{cc}$. For some conditions, such as the example in FIG. 5 with $\omega_w=1.05\omega_p$ and $r_s=r_{cc}$, the sensor can cover the center die with multiple scans but maybe with only pass the edge die with one or even none. One way to improve the sampling density on the edge die is to increase the number of loci on the wafer by reducing the offset between $\omega_w$ and $\omega_p$. However, this will increase the time period to scan one revolution over the wafer surface and thus may delay the detection of rapid changes of reflectance of a local area. The wafer slippage, both rotation and translation inside the recess, will also make the control of velocity offset within a small range very difficult. In reality, the smallest offset of the wafer and the platen velocity is about 3% to 5%, typically.

Figure 32:
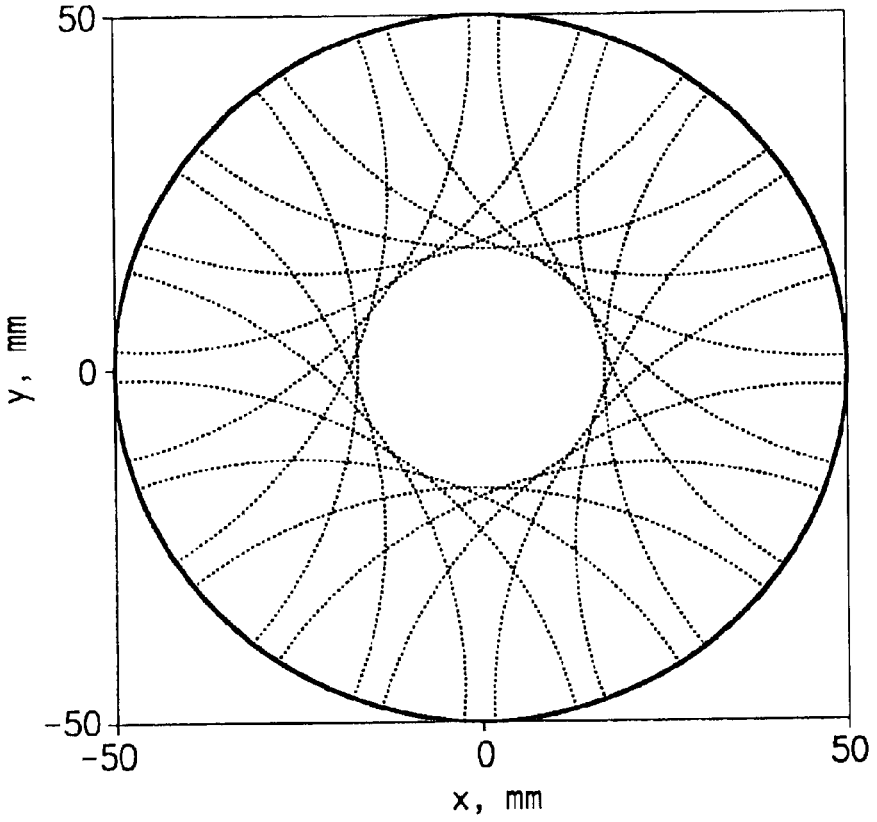
FIG. 32 shows the simulated loci for the reflectance sensor across the wafer at the condition $W_w-1.05w_p$ and $r_r=1.25r_{cc}$.

On the other hand, the distance between centers of the wafer and the platen $r_s$ may be changed during the polishing. This "sweeping motion" may help cover over a desired region on the wafer surface. FIG. 32 shows an example at $r_s=1.25\ r_{cc}$ with $\omega_w=1.05\omega_p$ and $\dot{r}_{cc}=0$, in which only the outer area is sampled. Compared with the high sampling density at the center in FIG. 18, the sampling density is much higher and uniform around the edge now. In practice, the entire wafer may be scanned first to roughly determine the overall surface condition, then the area at a particular radius of interest can be scanned with a higher sampling density for a better inference of the local condition. Moreover, two or more sensors can be installed at different radii $r_s$ and different angles (phase) on the same platen. The combined loci will give a higher and more uniform distributed sampling density of both the center and the edge region. Another important parameter for designing the sampling plan is the sampling frequency. In order to detect the variation of reflectance between the different sub-die areas and different dies, at least one data must be taken from each subdie along the sensor locus. It is preferable to have one or more replicants on each pattern to reduce the error due to random variation in measurement. For the 100 mm patterned wafer employed, about 40 subdies are located along a locus (ten dies along a locus with 4 subdies across each die diagonal). With at least one replication on each subdie area, totally about 100 points are required in the test, which corresponding to 100 Hz sampling rate at the typical wafer rotational speed of 60 rpm. Nevertheless, the sample size can be larger and more replicants can be taken to even out the effect of random error if the data acquisition system can provide a higher sampling rate.

Variance Components of the Surface Reflectance.

The surface reflectance of a patterned wafer varies with the surface roughness, pattern topography and area fraction, and the optical properties of coating materials. Due to the within-wafer nonuniform material removal, the surface topography and the remaining fraction of Cu during polishing may vary among different dies across the wafer. The within-wafer nonuniform polishing usually results from certain systematic sources, as nonuniform velocity distribution, pressure distribution, interfacial temperature distribution, slurry flow and contact conditions (Stine, 1998). Its effect on polishing always follows a systematic pattern and tends to be repeatable between wafers in the same lot. On the other hand, the wafer-level nonuniformity affects the pattern evolution on the same die with a similar trend. The relative rates of material removal between different patterns on a die will remain similar to another die at different location because the factors that affect wafer-level nonuniformity will have less interaction with the die- or device-level polishing behavior. For instance, the die-level polishing is mostly affected by the pattern geometry, such as linewidth and area fraction. Therefore, the variation of reflectance measurements on a die tends to follow the same distribution and is nested within the die. Based on this assumption, a two-level nesting variance structure is employed to decompose the effects of within-wafer and die-level nonuniform polishing. Assuming that the variance at each level is normally distributed, the reflectance at location j of die i on the wafer, $R_{ij}$, can be written as $$R_{ij}=\mu+W_i+D_{j(i)} \tag{23}$$

where $\mu$ is the average reflectance within a wafer from multiple loci, $W_i$ the die-to die (or within-wafer) effect on die i, and $D_{j(i)}$ the within-die effect at location j on die i. The total, within-wafer and within-die variances of surface reflectance are expressed as $\sigma_T^2$, $\sigma_W^2$, $\sigma_D^2$ respectively. Additionally, the within-die effect, $D_{j(i)}$, is assumed to be normal and the two-level variance components are assumed to be independent to each other. Therefore, the total variance of reflectance, $\sigma_T^2$, can be written as $$\sigma_T^2=\sigma_W^2+\sigma_D^2 \tag{24}$$

Figure 33:
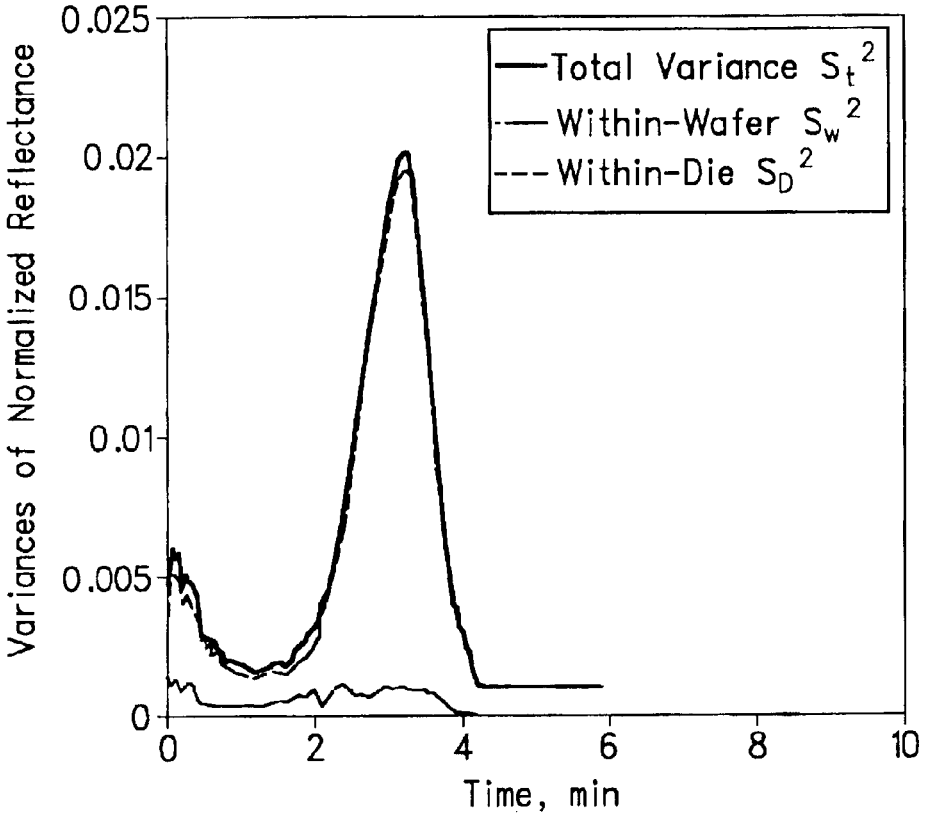
FIG. 33 shows the decomposition of the within-wafer and within-die variance for the in-situ measurements.

The results of decomposition of estimated variance components, $S_W^2$ and $S_D^2$ with respect to the in-situ measured data are plotted in FIG. 33. The value of each component and the F ratio, defined as $S_W^2/S_D^2$, for every 30 seconds are listed in Table 3 to examine the significance of within-wafer nonuniformity on the variation of surface reflectance. Additionally, the polishing results for all dies at the same radius are assumed to be similar and are combined into a subset for estimation of the die-level variation. The high F ratio on the wafer before polishing indicates that the within-die means at different radii are different and the probability of mean difference between dies, Pr(F) (which implies the existence of within-wafer nonuniformity), is about than 0.6. This is due to the variation of initial step-height from the deposition process. The within-wafer nonuniformity decreases after polishing starts, and remains at a low level with respect to the total variation. The confidence level of the hypothesis—there is a mean difference between the dies—is less 20%. This suggests that the surface is planarized (or topography becomes more uniform across the wafer) by polishing. The within-wafer variance and the F ratio even drop to very low levels, (Pr(F)~0), after the wafer-level endpoint is reached. This is because the underlying oxide surface is harder than Cu and can retain the surface planarity and the wafer-level polishing uniformity. On the other hand, the within-die effect contributes significantly to the total variation of surface reflectance throughout the process. The process endpoint can be determined based on the change of within-die variance component as a result of the drastic change of Cu area fraction. In practice, the total variance might be employed to approximate the within-die variance to determine the process endpoint. The small effect of within-wafer nonuniformity will not affect the accuracy of detection.

TABLE 3

Analysis of variance of two-level nested model for surface reflectance.

| Time (Minutes) | Within-Wafer Variance, $S_W^2$ | Within-Die Variance, $S_D^2$ | F Ratio ($S_W^2/S_D^2$) | Pr(F) |
|---|---|---|---|---|
| 0 | $15.94 \times 10^{-4}$ | $1.64 \times 10^{-3}$ | 0.965 | 0.59 |
| 0.5 | 3.89 | 2.62 | 0.149 | 0.07 |
| 1.0 | 2.62 | 1.58 | 0.166 | 0.08 |
| 1.5 | 3.88 | 1.54 | 0.252 | 0.14 |
| 2.0 | 7.49 | 2.51 | 0.299 | 0.17 |
| 2.5 | 9.30 | 8.45 | 0.110 | 0.05 |
| 3.0 | 9.22 | 18.11 | 0.051 | 0.02 |
| 3.5 | 7.24 | 13.67 | 0.053 | 0.02 |
| 4.0 | 1.39 | 3.08 | 0.045 | 0.01 |
| 4.5 | 0.15 | 1.01 | 0.015 | ~0 |
| 5.0 | 0.01 | 1.04 | 0.001 | ~0 |

Moreover, it may be noted that the within-wafer variance is just a indication of the nonuniform reflectance of the surface. It may not be directly correlated with the uniformity of the remaining Cu thickness. However, it directly represents the uniformity of surface condition. This information can be employed to monitor the across-wafer surface condition and uniformity. It may also be employed in a feedback control loop to adjust the process parameters, such as pressure distribution and velocities of wafer carrier and platen, to improve the uniformity of polishing.

Endpoint Detection Algorithms.

In previous sections, the characteristics of surface reflectance at endpoint and other stages of Cu polishing, in terms of moving average, distribution and the variation of the reflectance across the wafer, were discussed. These characteristics can be employed to design the endpoint detection algorithm(s). The moving average can be employed to detect the moment that the surface reflectance drops under a certain threshold as shown in FIG. 29. The threshold is determined by the average area fraction of Cu and the optical properties of surface materials with respect to the wavelength(s) employed. Because of the random effect of slurry scattering, surface roughness and random error, the threshold usually will deviate from the theoretical mean reflectance presented in the earlier section and must be determined based on the observations from a few preliminary tests. Moreover, the sampled reflectance corresponding to the "true" wafer-level endpoint will fall into a statistical distribution related to the variation in initial coating uniformity, the variation of process parameters and the random error from sampling and sensing. Accordingly, a hypothesis test must be conducted to ensure that the moving average M falls within a given interval with respect to an acceptable confidence level. Since the true variance of the surface reflectance is not known, the $100(1-\alpha)$ confidence interval is determined using the appropriate Student t sampling distribution for the sample standard deviation S (Montgomery, 1996).

$$\left(M - t_{\alpha/2,N-1} \cdot \frac{S}{\sqrt{N}}\right) \le \mu \le \left(M + t_{\alpha/2,N-1} \cdot \frac{S}{\sqrt{N}}\right) \tag{20}$$

Figure 34:
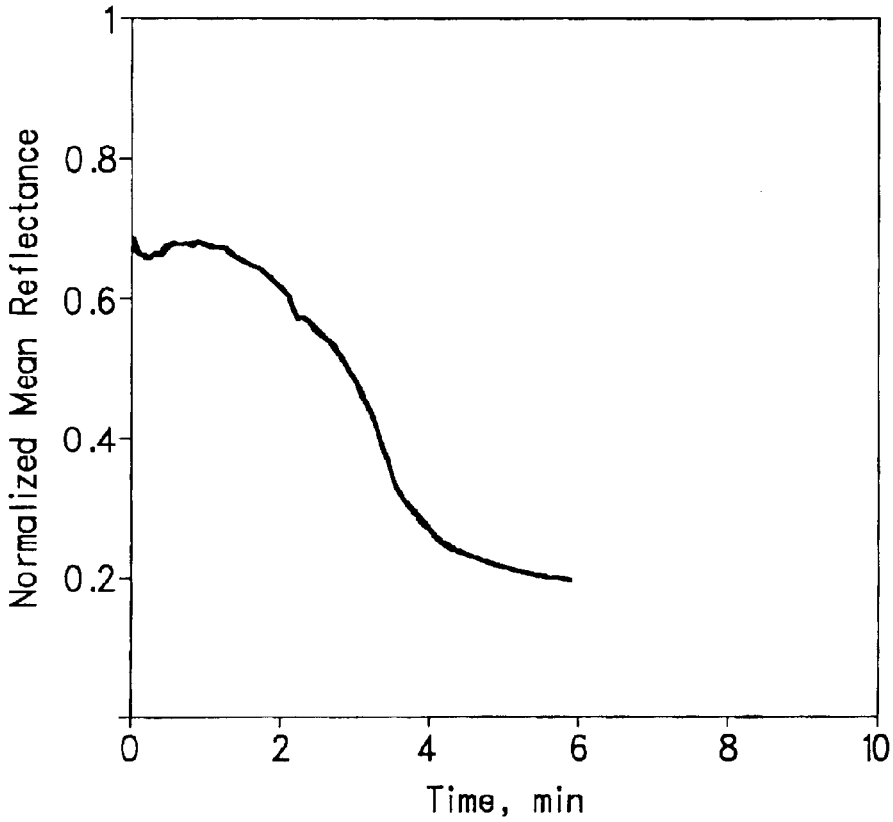
FIG. 34 shows the results of the sampled moving average versus time with estimated interval at 99.5% confidence interval.

FIG. 34 shows the results of the moving average of the surface reflectance versus time with an estimated interval at 99.5% confidence level ($\alpha$=0.005). Since the sample size N is very large, the estimated true mean is confined to a small interval. Moreover, the threshold may also have its underlying distribution from the historical data. It may be ambiguous sometimes to determine the endpoint from the overlapping of the two confidence intervals. The threshold also varies with different chip layout and design. It may be time-consuming to develop a new endpoint detection recipe for every change or new chip design.

Compared with the moving average, the variance (or standard deviation) of surface reflectance provides a more robust means to detect the endpoint. The variance shows a clear change at the onset of endpoint in FIG. 30. The endpoint can be determined based on both the slope and the threshold level of the variance curve. Because of the high reflectance difference between Cu and oxide, the change of variance with time is usually much drastic right before the endpoint for any chip design. The variance of surface also remains at a low level after the endpoint because the oxide with high selectivity will retain the surface uniformity. Similarly, the variance can be estimated from the measurements based on a desired confidence interval. Without knowing the true variance of the surface reflectance $\sigma^2$, the variance interval with $100(1-\alpha)$ confidence level is given based on the Chi-square ($\chi^2$) distribution.

$$\frac{(N-1)S^2}{\chi^2_{\alpha/2,N-1}} \le \sigma^2 \le \frac{(N-1)S^2}{\chi^2_{1-\alpha/2,N-1}} \tag{21}$$

Figure 35:
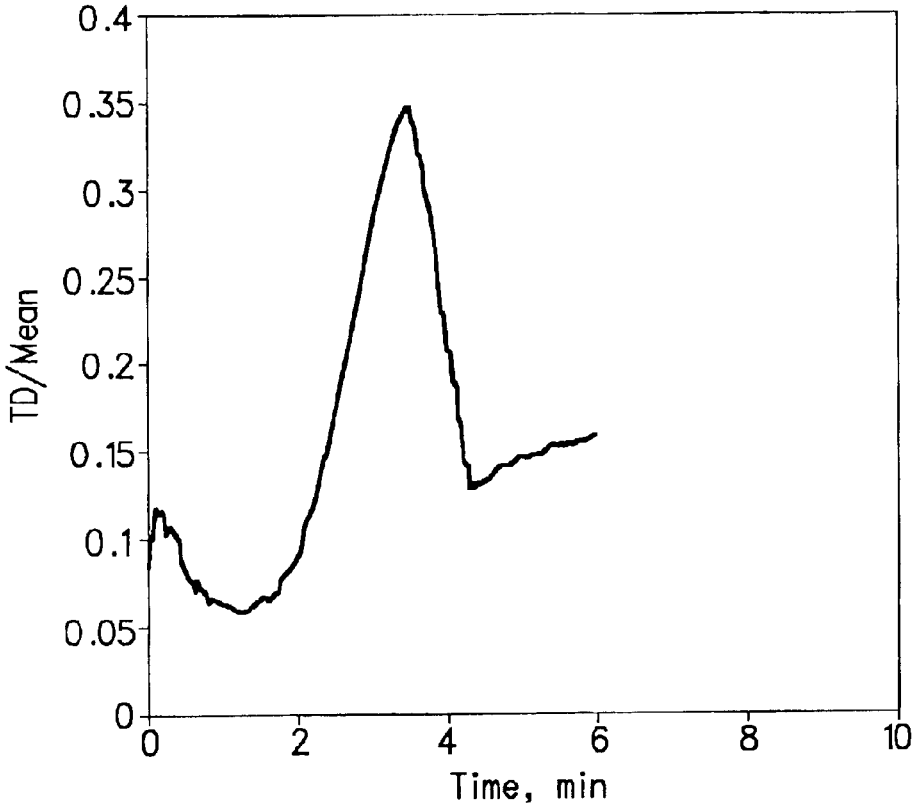
FIG. 35 shows the results of in-situ measurements of the ratio of the standard deviation to the mean reflectance (wafer-level).

It is shown that the estimated variance does not vary significantly within a short period of overpolishing. The threshold of variance will also approximately remain a constant between runs for a given pattern design. Therefore, the endpoint is much easily determined based on the variance information than from the mean (moving average). In practice, the ratio of standard deviation to the mean reflectance can be employed to incorporate the characteristics of mean and variance of reflectance for endpoint detection, as shown in FIG. 35. The endpoint is indicated as a local minimum and can be determined without the complexity of calculating the slope and the confidence intervals.

Figure 36:
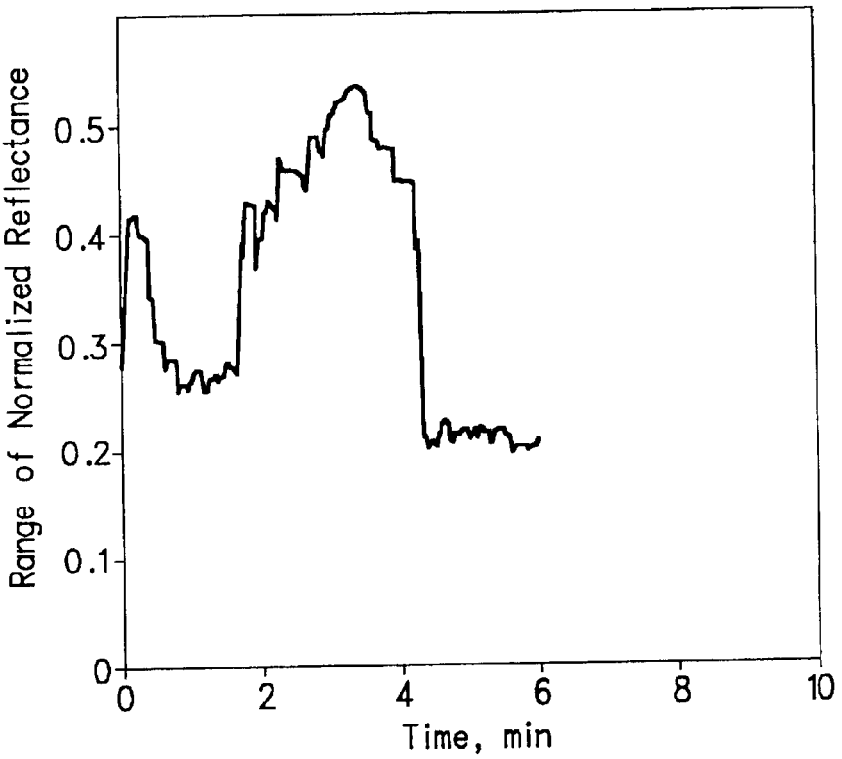
FIG. 36 shows the results of the range of surface reflectance versus polishing time (wafer-level).
Figure 37A:
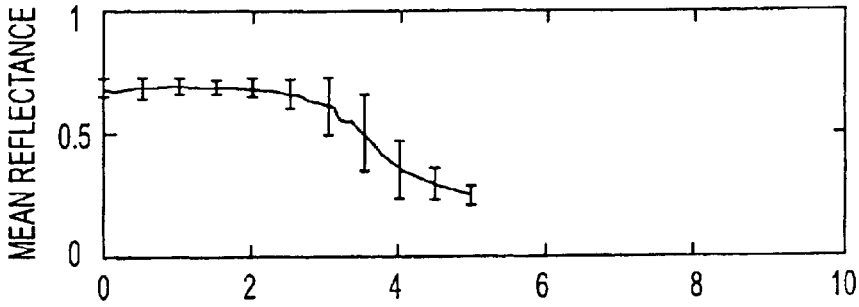
FIG. 37 shows experimental validation for various in-situ sensing and endpoint detection schemes.
Figure 37B:
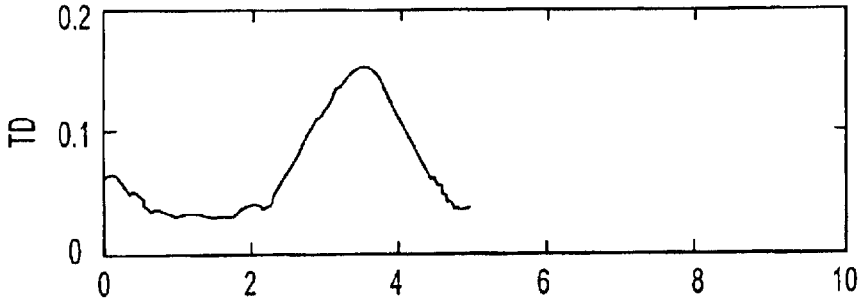
Figure 37C:
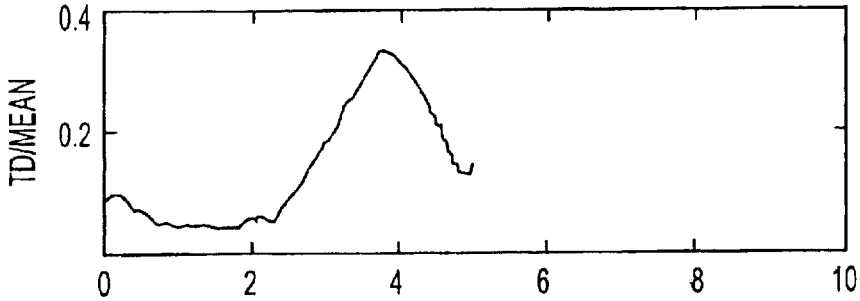
Figure 37D:
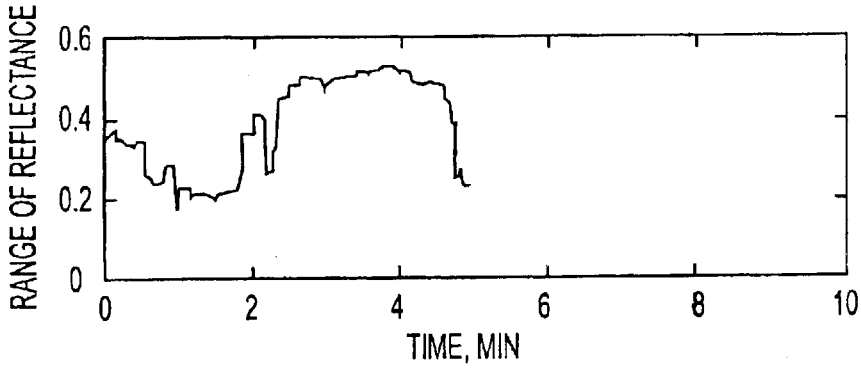

In addition to the wafer-level endpoint, the onset of endpoint on the dies can also be determined based on mapping of sampling loci onto the wafer surface. The surface conditions on different zones, such as "rings" at different radii, can be determined based on the same techniques employed in the wafer-level endpoint detection. The sampling loci can be designed as described in the earlier section to select the sensing area and resolution. Moreover, the mean, variance, and distribution of the surface reflectance also provides information for different stages in the polishing process. The variance and the variance to mean ratio reach a minimum, and the distribution becomes normal when the Cu pattern is planarized. The range of the reflectance increases drastically when the underlying oxide starts to expose, as shown in FIG. 36. The variance to mean ratio reaches a maximum when the majority of the excess Cu on the surface is cleared. This information can be integrated as part of the in-situ sensing technique to determine progress of the CMP process. For multi-step polishing processes, this information can also be used to determine the endpoints of each step and increase the capability of process control. An experiment was conducted to validate the effectiveness of various endpoint detection scheme with the same process condition listed in Table 2. Polishing was stopped as soon as the standard deviation, the standard deviation to mean ratio, and the range indicate the onset of (wafer-level) endpoint, as shown in FIG. 37. Pictures of the wafers were evaluated and agree with the results achieved by the sensing system, and it was observed that Cu is cleared up on the surface. Although it is hard to identify from observation, an ultra-thin Ta barrier, which is more transparent to the light than the thick layer, may still remain on the surface and may not be detected by the optical sensor. In practice, a short period of overpolishing may be applied after the sensor detects the endpoint to ensure that all the metals are completely removed.

Nomenclature—the following nomenclature is used in the preceding sections:

$A_f$=area fraction of metal pattern

H=hardness of coating material ($N/m^2$)

H'=apparent hardness of a composite surface ($N/m^2$)

h=thickness of the material removed on wafer surface (m)

$h_o$=initial coating thickness (m)

$k_p$=Preston constant ($m^2/N$)

$k_w$=wear coefficient $p_{av}$=nominal pressure on wafer ($N/m^2$)

$\bar{p}$=average pressure on a pattern ($N/m^2$)

r=random error in thickness measurement (m)

t=experiment duration (s)

t*=overpolishing duration (s)

$v_R$=relative linear velocity of wafer (m/s)

w=pattern linewidth (m)

x, y, z=Cartesian coordinates (m)

$\Delta h$=oxide overpolishing (m)

$\delta$=Cu dishing (m)

$\lambda$=pattern pitch (m)

$\mu$=average overpolishing on a die $\phi$=dimensionless geometrical function $\nu$=Poisson's ratio As taught by the foregoing description and examples, an improved method apparatus for chemical mechanical polishing of semiconductor wafers has been provided by the present invention. The foregoing description of specific embodiments and examples of the invention have been presented for the purpose of illustration and description, and although the invention has been illustrated by certain of the preceding examples, it is not to be construed as being limited thereby. They are not intended to be exhaustive or to limit the invention to the precise forms disclosed, and obviously many modifications, embodiments, and variations are possible in light of the above teaching. It is intended that the scope of the invention encompass the generic area as herein disclosed, and by the claims appended hereto and their equivalents.

What is claimed is:

1. A method of monitoring the condition of a semiconductor wafer surface, comprising the steps of:

rotating a first sensor about a platen axis at a platen angular velocity $\omega_p$;

rotating the wafer about a wafer axis at a wafer angular velocity $\omega_W$ that is not equal to $\omega_p$, thereby allowing the sensor to scan the surface in a pattern that comprises a plurality of loci;

collecting a surface reflectance datum from the sensor at each of a plurality of points along each loci;

mapping the surface reflectance data to one or more localized zones on the surface; and characterizing the condition of the surface in each of the localized zones based on one or more statistical measures for the reflectance in the zones.

2. The method of claim 1, wherein the loci are substantially uniformly distributed across the surface.

3. The method of claim 1, wherein the sensor is located a distance $r_s$ from the platen axis, the platen axis is displaced from the wafer axis by a distance $r_{cc}$, and $r_s \neq r_{cc}$.

4. The method of claim 3, wherein a second sensor located at a distance $r_{s,2}$ from the platen axis is rotated about the platen axis at angular velocity $\omega_p$, and the surface reflectance data are collected from the first and second sensors.

5. The method of claim 4, wherein $r_s$ and $r_{s,2}$ are not collinear.

6. The method of claim 1, wherein the platen axis and wafer axis are translated at a non-zero relative sweeping velocity $r_{cc}$ that is perpendicular to both of the axes.

7. A chemical mechanical polishing (CMP) apparatus comprising:

a polishing platen that rotates around a platen axis at a platen angular velocity $\omega_p$;

a sensor located on the platen and located at a sensor radius $r_s$ from the platen axis;

a wafer carrier for holding a wafer in cooperative relationship with the rotating platen while rotating the wafer around a wafer axis at a wafer angular velocity $\omega_W$ that is not equal to $w\omega_p$, thereby allowing the sensor to scan the surface in a pattern that comprises a plurality of loci, wherein the loci are substantially uniformly distributed across the surface, the wafer carrier having multiple chambers that allow for independently varying pressure within the chambers that urge against the wafer at corresponding multiple localized zones on the wafer; and a process controller configured to record a surface reflectance datum from the sensor at each of a plurality of points along each loci and maps the surface reflectance data to the localized zones on the surface.

8. The CMP apparatus of claim 7, wherein the wafer axis and the platen axis are displaced by distance $r_{cc}$ and $r_s \neq r_{cc}$.

9. The CMP apparatus of claim 7, wherein the mapped surface reflectance data are used to control the polishing independently within each of the multiple localized zones.

10. The CMP apparatus of claim 7, wherein the mapped surface reflectance data indicate the state of polishing of the wafer within each of the multiple localized zones.

11. The CMP apparatus of claim 7, wherein the process controller is further configured to process the mapped surface reflectance data to determine the state of polishing within each of the localized regions, and to selectively vary the pressure independently within each of the multiple chambers responsive to the state of polishing determination.

12. The CMP apparatus of claim 7, wherein the multiple chambers are formed in a flexible membrane and comprise a center chamber surrounded by one or more concentric chambers.

13. The CMP apparatus of claim 7, wherein the multiple chambers comprise a center circular chamber and three annular, concentric chambers.

14. The CMP apparatus of claim 7, wherein the sensor comprises at least one fiber optic sensor having a bundle of transmit and receive optical fibers terminating at a sensor tip, a light source which transmits light through the transmit optical fibers to the surface of the wafer, and a photodetector which receives reflected light from the surface of the wafer through the receive optical fibers.

15. The CMP apparatus of claim 14, wherein the transmit and receive optical fibers are oriented substantially normal to the surface of the wafer.

16. The CMP apparatus of claim 14, wherein the sensor tip is spaced apart from the surface of the wafer to form a gap, and the size of the gap is in the range of about 200 to 250 mils.

17. The CMP apparatus of claim 14, wherein the light source is a light emitting diode which emits light at a wavelength of about 880 nm.

18. The CMP apparatus of claim 7, wherein the materials on the surface of the wafer are any one of, or a combination of, conductive, insulating or barrier materials.

19. The CMP apparatus of claim 17, wherein the materials may be patterned on the surface of the wafer.

20. The CMP apparatus of claim 7, wherein the sensor scans through the center of the wafer.

21. The CMP apparatus of claim 7, wherein the wafer axis and/or the platen axis are translatable in a direction perpendicular to the axes such that the platent axis and wafer axis are moved relative to each other with a non-zero sweeping velocity.

22. A method of chemical mechanical polishing (CMP) of a semiconductor wafer in a CMP machine, comprising the steps of:

urging a polishing pad against the semiconductor wafer carried on a wafer carrier, the wafer carrier having multiple chambers that allow for independently varying pressure within the chambers that urge against a wafer at corresponding localized zones on the wafer;

scanning a sensor across the surface is a pattern that comprises a plurality of loci;

collecting a surface reflectance datum from the sensor at each of a plurality of points along each loci;

mapping the surface reflectance data to the localized zones;

characterizing the condition of the surface in each of the localized zones based on one or more statistical analyzes of the data mapped to each localized zone; and independently adjusting the pressure within one or more of the chambers responsive to the surface condition Within each of the corresponding localized zones.

23. The method of claim 22, wherein the step of independently adjusting further comprises:

reducing or stopping the chemical mechanical polishing independently within each localized zone when the statistical measures indicate a change in the surface condition in that zone.

24. The method of claim 23, wherein the chemical mechanical polishing is reduced or stopped in a zone when one or more of the standard deviation, the standard deviation to mean ratio, and the age of the surface reflectance data within a localized zone indicate the onset of an endpoint.

25. The method of claim 23, wherein the chemical mechanical polishing is reduced or stopped in a localized zone when the change in reflectance in that zone exceeds a predetermined threshold value.

26. The method of claim 22, wherein the step of independently adjusting further comprises:

reducing or stopping the chemical mechanical polishing, independently within each localized zone according to the one or more statistical measures wherein the statistical measures are selected from the mean, standard deviation, variance, range and ratios or other mathematical combinations thereof, of the surface reflectance data mapped to the localized zone.

27. The method of claim 22, further comprising:

calculating the variance in the surface reflectance data;

determining the degree of topographical variations in the surface reflectance data on the surface of the wafer based on the variance of the data at the localized zones; and controlling the polishing process at the localized zones on the wafer responsive to the topographical variations.

* * * * *